US011510448B2

(12) United States Patent
Adams

(10) Patent No.: US 11,510,448 B2
(45) Date of Patent: Nov. 29, 2022

(54) HAIR EXTENSION BAR AND METHOD OF USE

(71) Applicant: Crystal Adams, Boca Raton, FL (US)

(72) Inventor: Crystal Adams, Boca Raton, FL (US)

( * ) Notice: Subject to any disclaimer, the term of this patent is extended or adjusted under 35 U.S.C. 154(b) by 559 days.

(21) Appl. No.: 16/411,895

(22) Filed: May 14, 2019

(65) Prior Publication Data

US 2020/0029640 A1 Jan. 30, 2020

Related U.S. Application Data

(60) Provisional application No. 62/702,565, filed on Jul. 24, 2018.

(51) Int. Cl.

| | |
|---|---|
| ***A41G 5/00*** | (2006.01) |
| ***A45D 24/38*** | (2006.01) |
| *A45D 24/10* | (2006.01) |

(52) U.S. Cl.

CPC ..... *A41G 5/0086* (2013.01); *A41G 5/0046* (2013.01); *A41G 5/004* (2013.01); *A45D 24/10* (2013.01); *A45D 24/38* (2013.01)

(58) Field of Classification Search

CPC ..... A45D 44/00; A45D 44/02; A45D 44/04; A45D 44/14; A45D 2002/003; A45D 24/02; A45D 24/10; A45D 24/38; A45D 19/005; A45D 19/0066; A45D 19/012; A45D 19/016; A45D 19/026; A45D 20/14;

(Continued)

(56) References Cited

U.S. PATENT DOCUMENTS

| | | | | |
|---|---|---|---|---|
| 3,942,839 | A | 3/1976 | Chalk | |
| D450,339 | S | 11/2001 | Eason | |
| 10,149,529 | B1 * | 12/2018 | Turner | A45D 8/00 |

(Continued)

FOREIGN PATENT DOCUMENTS

| | | |
|---|---|---|
| FR | 2473465 A1 | 7/1981 |
| RU | 2694610 C1 | 1/2002 |

OTHER PUBLICATIONS

Unboxing: Hair Extension Organizer Stand—DoctoredLocks.com https://www.youtube.com/watch?v=eAoEfE2Gung (Year: 2016).*

(Continued)

*Primary Examiner* — Rachel R Steitz
*Assistant Examiner* — Karim Asqiriba
(74) *Attorney, Agent, or Firm* — Allen D. Hertz, P.A.; Allen D. Hertz

(57) ABSTRACT

A hair extension bar comb retains hair for a coloration or treatment process on an elongated base. In one embodiment, first and second comb teeth rows are respectively mounted in parallel on corresponding laterally spaced apart parallel side regions of the base (typically on a top flat base surface). In use, some teeth of at least one comb teeth row captures extension hair therein. A coloration/treatment process is engaged on captured extension hair in the lateral space between the first and the second comb teeth rows. A floor or table stand may be provided with a mounting coupler on the bottom of the base. A hair extension storage bag is elongated, defining a vertical bag cavity with an upper edge lip closure system. A horizontal bar with a single comb teeth row is mounted in the upper region of the bag cavity. Comb teeth capture extension hair which falls down into the vertical bag cavity. A vertical closure system is also included.

25 Claims, 15 Drawing Sheets

(58) Field of Classification Search
CPC ..... A45G 5/00; A45G 5/004; A45G 5/0086; A45G 5/0046
See application file for complete search history.

(56) References Cited

U.S. PATENT DOCUMENTS

| | | | | |
|---|---|---|---|---|
| 10,433,628 | B2 * | 10/2019 | Palmer | A45D 20/04 |
| 10,779,632 | B2 * | 9/2020 | Roberts | A41G 5/0086 |
| 2005/0109367 | A1 * | 5/2005 | Smith | A45D 44/14 132/333 |
| 2006/0289368 | A1 * | 12/2006 | Abney | A47F 7/065 211/13.1 |
| 2009/0008347 | A1 * | 1/2009 | Bell | A47F 5/02 211/183 |
| 2011/0012363 | A1 | 1/2011 | Finnell | |
| 2014/0191634 | A1 * | 7/2014 | Smiley | D01G 7/12 248/205.2 |
| 2015/0351574 | A1 * | 12/2015 | Eslami | A47G 25/483 206/388 |

OTHER PUBLICATIONS https://www.henshallhair.com.au/hair-extensions/tools/ (Year: 2018).*
https://www.google.com/search?q=henshall+hair+extension+trolley&rlz=1C1GCEB_enUS825US826&source=Int&tbs=cdr%3A1%2Ccd_min%3A%2Ccd_max%3A07%2F24%2F2018&tbm= (Year: 2018) (Year: 2018).*
Hair Extension Holder—Satin Lined Storage Case With Handle Hanger Keeps Your & online _ eBay, https://www.ebay.com/p/Hair-Extension-Holder-Satin-Lined-Storage-Case-With- . . . .
Hair Works 4-in-1 Hair Extension Style Caddy Lightweight-Waterproof-Portable! 635346897269 _ eBay a, https://www.ebay.com/itm/Hair-Works-4-in-1-Hair-Extension-Style-Caddy- . . . .
Hair Works 4-in-1 Hair Extension Style Caddy—Lightweight-Waterproof-Portable! 635346897269 _ eBay b, https://www.ebay.com/itm/Hair-Works-4-in-1-Hair-Extension-Style-Caddy-.
Hair Works 4-in-1 Hair Extension Style Caddy Lightweight-Waterproof-Portable! 635346897269 _ eBay c, https://www.ebay.com/itm/Hair-Works-4-in-1-Hair-Extension-Style-Caddy- . . . .
Wig Hangers Hair Extension Carrier Storage Case Wig Stands Dust Proof Bag Black, https://www.ebay.com/i/142739279630?cnn=ps.

* cited by examiner

HAIR EXTENSION BAR AND METHOD OF USE

CROSS REFERENCE TO RELATED APPLICATIONS

This is a regular patent application claiming the benefit of Ser. No. 62/702,565 filed Jul. 24, 2018, the contents of which is incorporated herein by reference thereto.

FIELD OF THE INVENTION

The present invention relates to a hair extension bar comb tool and a storage bag for hair extensions with an interior comb hanger. More specifically, the present invention relates to a hair extension comb tool and a respective method of use thereof, where hair extensions are woven through teeth extending upward from one or both of a pair of combs and a top surface and each of associated side surfaces support and provide backing for hair strands of the hair extension during washing, drying, styling, coloring, etc.

BACKGROUND OF THE INVENTION

There is a need for a system wherein one or more hair extensions can be mounted on a stand such that the stylists can color or treat the mounted hair. Typically, a stylist needs two hands for any coloration process and does not have a third hand to hold the hair weft or extension. Further, there is a need to have an easy-to-clean base, bar or platform upon which is mounted the hair extension prior to coloration. Prior art systems do not provide sufficient functionality.

A prior art "Wig Hangers Hair Extension Carrier Storage Case Wig Stands Dust Proof Bag Black" is disclosed at <https://www.google.com/search?source=hp&ei=xdm-CXK6JFbLb5gLvgo7IBg&q=ebay+hair+exension+wig+storage+bag&btnK=Google+Search&oq=ebay+hair+exension+wig+storage+bag&gs_1=psy-ab.3..33i10i29912.981.11992..12257...0.0..0.259.2499.32jlj1....2..0....1..gws-wiz....0..0i131j0j33i160j0i13j0i13i30j0i22i30j0i8i13i30j3-3i22i10i29i30j33i10j33i10i160.W9pcP 2vcwNs> (captured Mar. 8, 2019). This Wig Hanger, when opened, presents a vertically oriented, generally rectangular flat surface with a semi-circular top edge and hanger extending slightly above the semi-circular top edge. A horizontal bar, which appears to be a two-piece bar which can swing open at one edge or pinch the hair extension between the two pieces, grasps the top weft edge of the hair extension. The extension hair extending vertically down from the pinch bar can be forced into a transparent pocket formed below the pinch bar. Apparently, the Wig Hanger can be folded onto itself along a central vertical crease running from the apex of the semi-circular top edge and hanger to the lower edge of the Wig Hanger. No comb is used to hold the hair extensions.

A "Hair Extension Holder—Satin Lined Storage Case With Handle Hanger Keeps Your" is disclosed at <https://www.ebay.com/p/Hair-Extension-Holder-Satin-Lined-Storage-Case-With-Handle-Hanger-Keeps-Your/11027611977?iid=153343144106&chn=ps> (captured Mar. 8, 2019). This Hair Extension Holder, when opened, presents a vertically oriented, rectangular flat surface with a hanger extending above the top edge of the rectangular flat surface. A series of horizontal bands near the top edge region supports mid-section portions of hair extensions. A lower portion of these "hanging" hair extensions is wrapped under a lower series of horizontal bands. When the hair extensions are captured around and beneath these upper and lower bands, the rectangular flat hanger is folded onto itself to cover the hair extensions. No comb is used to hold the hair extensions.

A "Hair Works 4-in-1 Hair Extension Style Caddy Lightweight-Waterproof-Portable" is disclosed at <https://www.ebay.com/itm/Hair-Works-4-in-1-Hair-Extension-Style-Caddy-Lightweight-Waterproof-Portable/332730577679?epid=1072042274&hash=item4d7849b30f:g:aWkAAOSwOdpXyyNU&frcectupt=true> (captured Mar. 8, 2019). The Hair Works 4-in-1 Hair Extension Style Caddy includes a tooth comb with widely spaced apart teeth. The elongated tooth comb is mounted in an interior section of a clam shell container. The Hair Works 4-in-1 Caddy has a two-piece clam shell construction. The hair extension tooth comb extends from an interior surface of a first clam shell element, the hair extension is mounted on the elongated tooth comb, and then the second clam shell element is closed. The second clam shell element is pivotally attached to the first clam shell element. The extension hair extends outboard from the bottom of the closed clam shell structure. The stylist can then wash, color and dry the extension hair extending outboard from the bottom of the closed clam shell structure.

OBJECTS OF THE INVENTION

It is an object of the invention to provide a hair extension bar comb tool permitting the stylist to mount hair extensions thereon for further treatment, colorization, highlighting, washing and drying.

It is a further object to permit such hair extension bar comb to be mounted above a floor or table.

It is an additional object to provide a storage bag for hair extensions.

BRIEF SUMMARY OF THE PRESENT INVENTION

The hair extension bar comb retains a hair extension thereon and is adapted to be removably mounted to a floor or table stand. The hair extension bar comb has an elongated base having laterally spaced apart, generally parallel side regions. First and second comb teeth rows are respectively mounted on corresponding, laterally spaced apart, parallel side regions. Each comb teeth row has a multiplicity or a plurality of teeth. A portion of these teeth in at least one comb teeth row captures extension hair therein. In one embodiment, the hair extension bar comb includes a mounting coupler adapted to removably attach the base to a floor or table stand.

The comb teeth row defines a plurality aligned of teeth to enable a coloration process on captured extension hair in the lateral space between the first and the second comb teeth rows and between the laterally spaced apart first and second top side regions.

The storage bag for hair extensions includes an elongated bag having an upper edge lip and an upper closure system substantially along the upper edge lip. The elongated bag defines an elongated vertical bag cavity beneath the upper edge lip. A horizontal bar is mounted near the upper bag edge lip. A substantially horizontal comb teeth row is mounted on the horizontal bar. The comb teeth row includes a plurality aligned of teeth either horizontally extending from the horizontal bar or extending at an acute angle with respect to the bar. At least a portion of the comb teeth capture the extension hair such that the extension hair falls down into the vertical bag cavity for storage therein.

BRIEF DESCRIPTION OF THE DRAWINGS

Further objects and advantages of the present inventions are discussed in the connection with the detailed description of the embodiments when taken in conjunction with the accompanying drawings.

DETAILED DESCRIPTION OF THE PRESENT INVENTION

Figure 1:
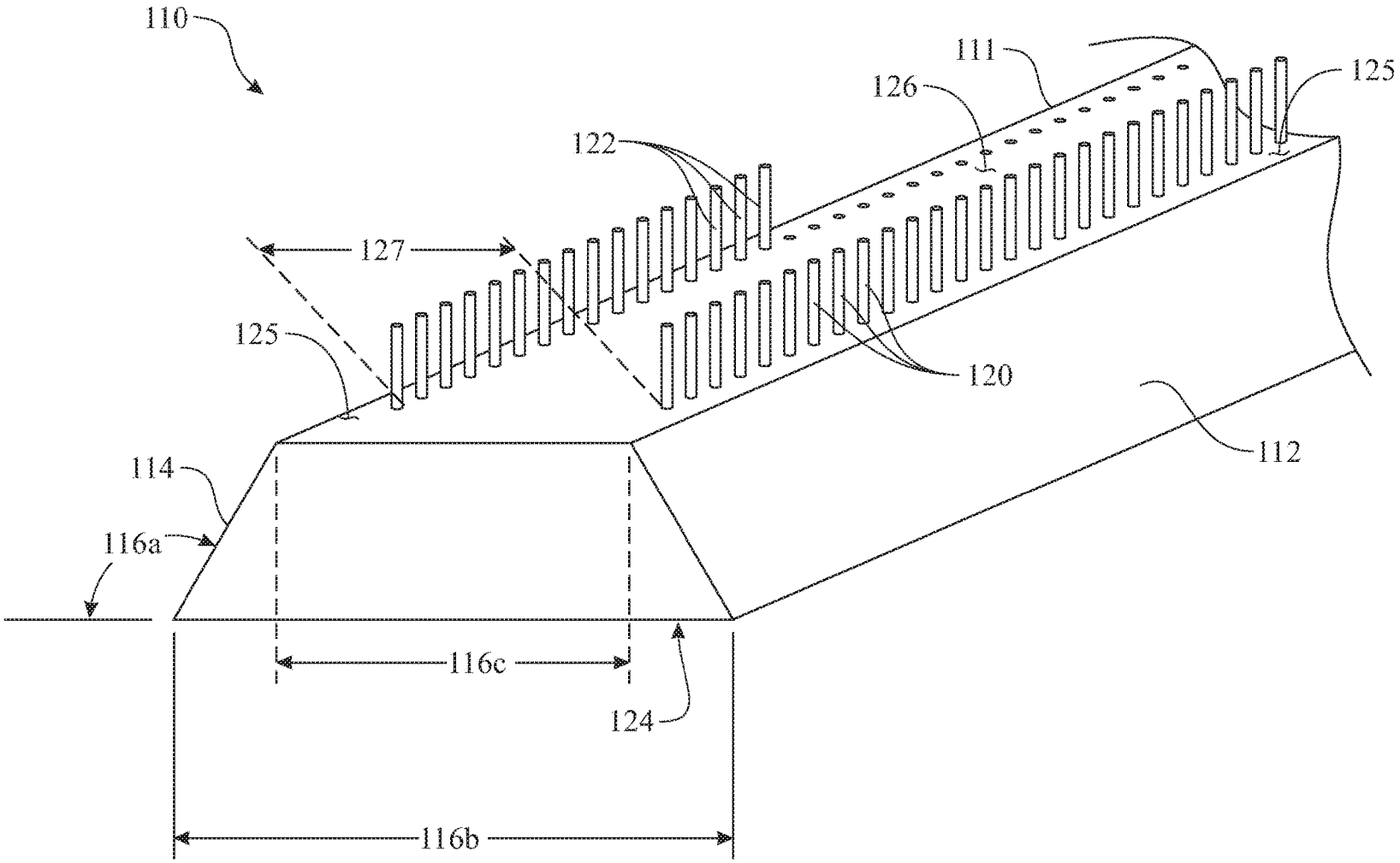
FIG. 1 diagrammatically illustrates an isometric side view of a first exemplary hair extension bar comb tool.
Figure 4:
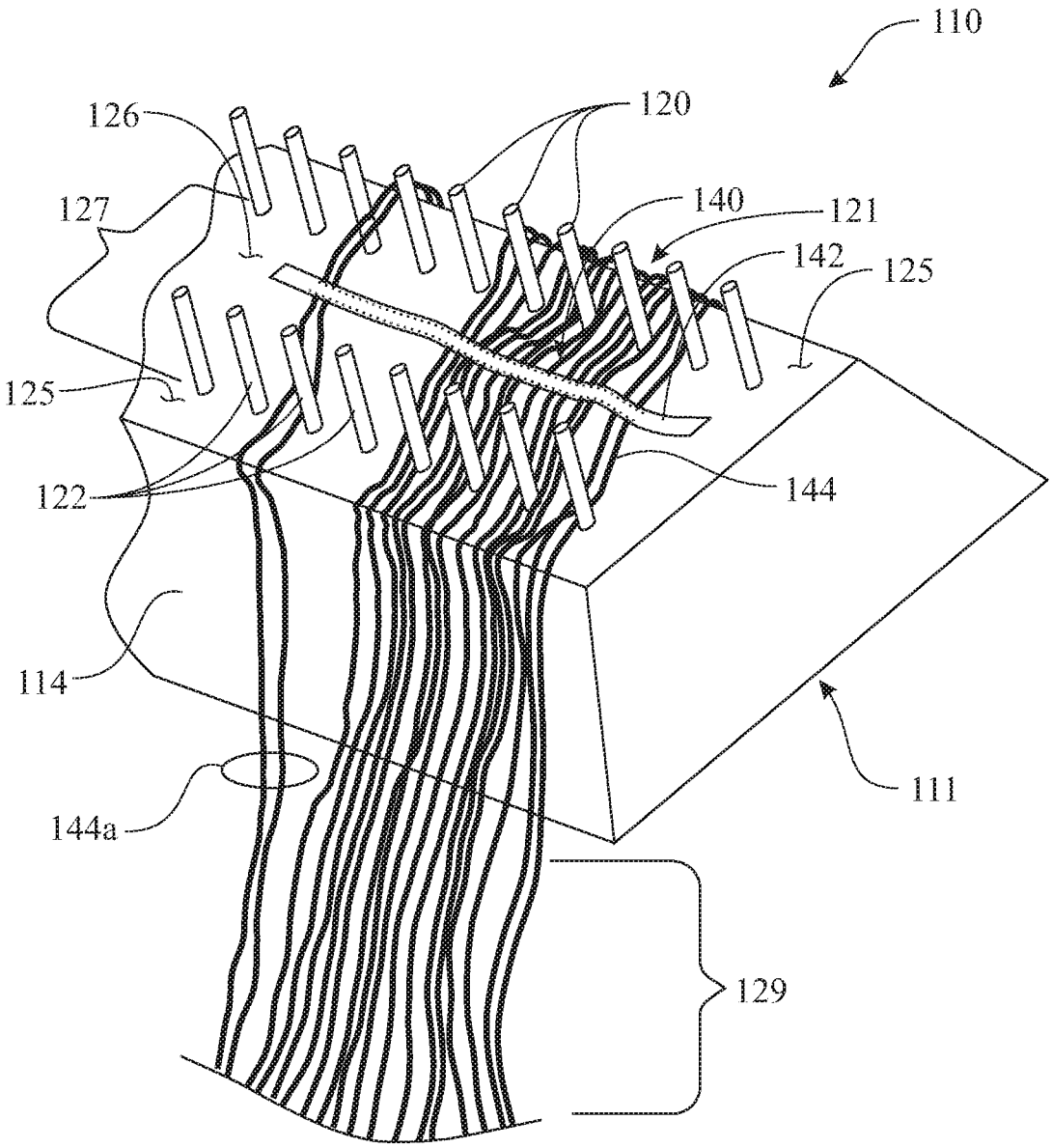
FIG. 4 diagrammatically illustrates an isometric side view of a section of a hair extension weft centered on a flat working region located between a first comb row and a second comb row.

FIG. 1 diagrammatically illustrates a hair extension bar comb tool 110. A hair extension bar 111 of the comb tool 110 ("hair extension bar comb tool 110") has a generally planar bottom or lower surface 124 and a parallel, generally planar top surface 126. The hair extension bar/platform 111 is sometimes referred to as a platform 111. Sloped sides 112, 114 of the bar/platform 111 depend from the planar top surface 126 at an obtuse angle 116*a*. This angle is approximately 60°. Two sets of comb teeth 120, 122 extend upward from upper surface 126 of the platform in a generally vertical direction. A lateral span 116*c* of the upper surface 126 is less than a lateral span 116*b* of the lower surface of the comb tool 110. In one embodiment, tool 10 is mounted on a stand 150 (FIG. 7) and is substantially horizontal while in use. However, the hair extension bar comb tool 110 is designed to be removed from the stand 150 (FIG. 7) at times to facilitate washing (similar to the process illustrated in FIG. 11) and drying (similar to the process illustrated in FIG. 12) and transporting of a comb-mounted hair extension 140 (FIG. 4).

Figure 7:
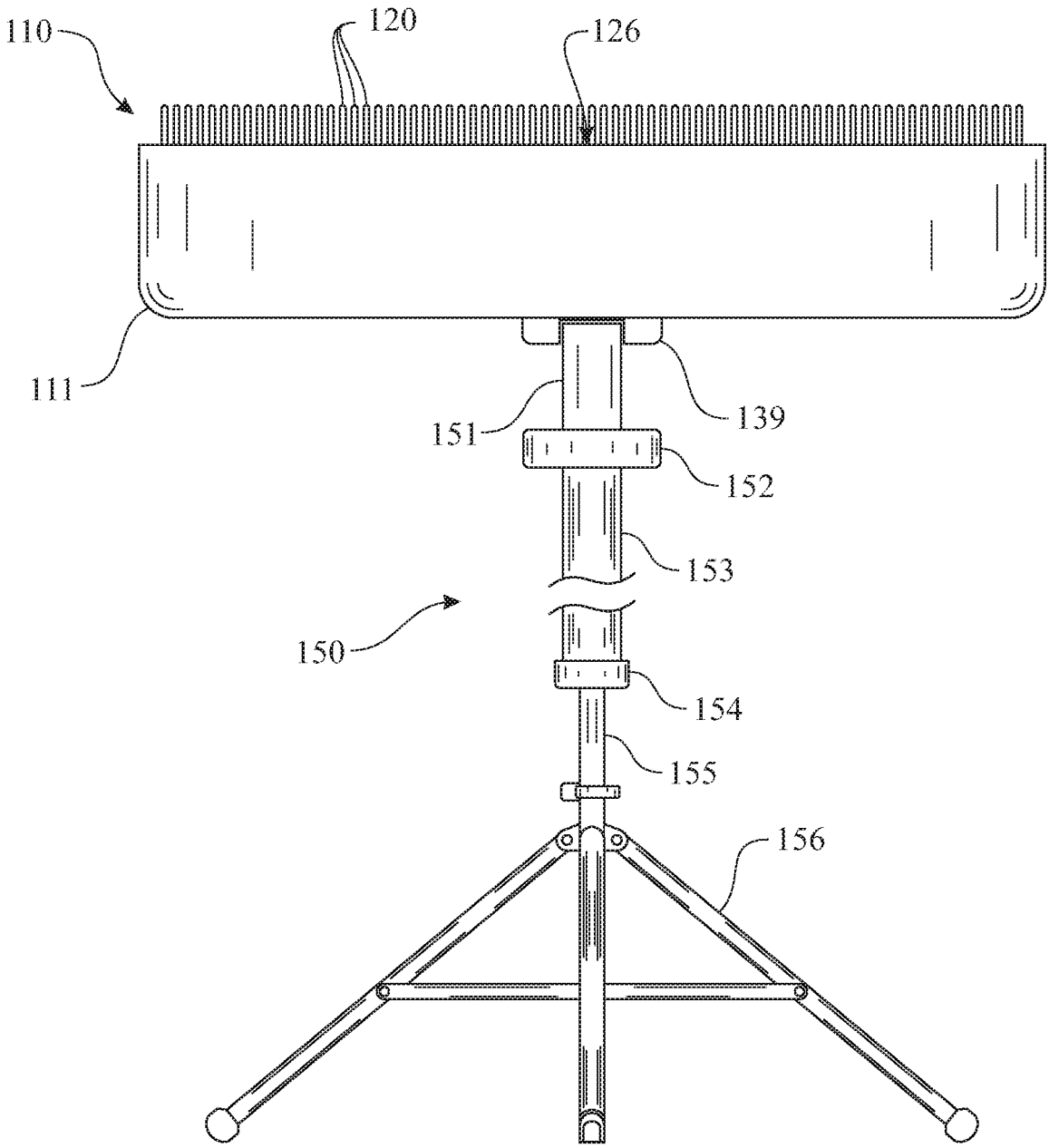
FIG. 7 diagrammatically illustrates a side view of an exemplary stand mount for the hair extension bar comb tool.
Figure 8:
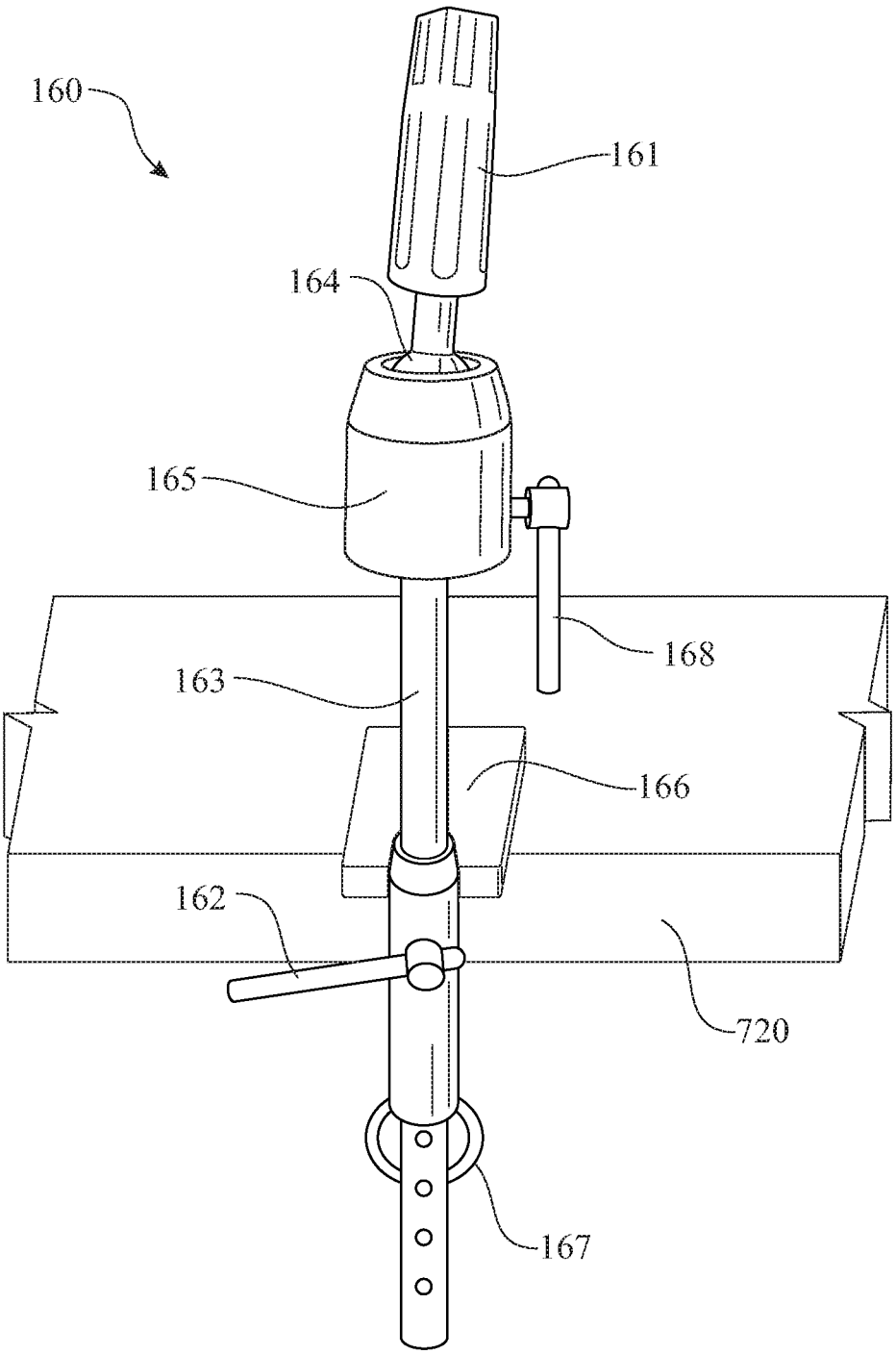
FIG. 8 presents a front elevation view of an optional desk mounting bracket for supporting any of the embodiments of the exemplary hair extension bar comb tools.

In general, the comb teeth 120, 122 extend the length of bar/platform 111. In FIG. 1, a portion of the comb teeth 122 are represented by a series of circles. FIG. 7 shows that the lower surface 124 of the bar/platform 111 includes a coupler mechanism which co-acts with the stem extending upward from either a floor mount 150, a table mount 160 or a mannequin head mount or stand. The bar coupler 139 extending below the lower surface 124 can be configured such that it fits on a stand for a mannequin head. Rather than a floor/table stand 150, 160, the bottom of the stand stem 151 or 153 may include a clamp-down grip 166, 167 (FIG. 8) such that the hair extension bar comb tool 110 is mounted on a table top or shelf 720 (FIG. 8).

In one embodiment of the comb tool 110, the hair extension bar/platform 111 is about 18-24 inches long. The bar or platform 111 includes a top planar surface 126 having a width 116*c* of about 2 inches and a bottom or lower planar surface 124 having a width 116*b* of about 3 inches. Comb teeth 120, 122 extend substantially vertically above the generally planar top surface 126 for a distance of about 1 inch.

Figure 14:
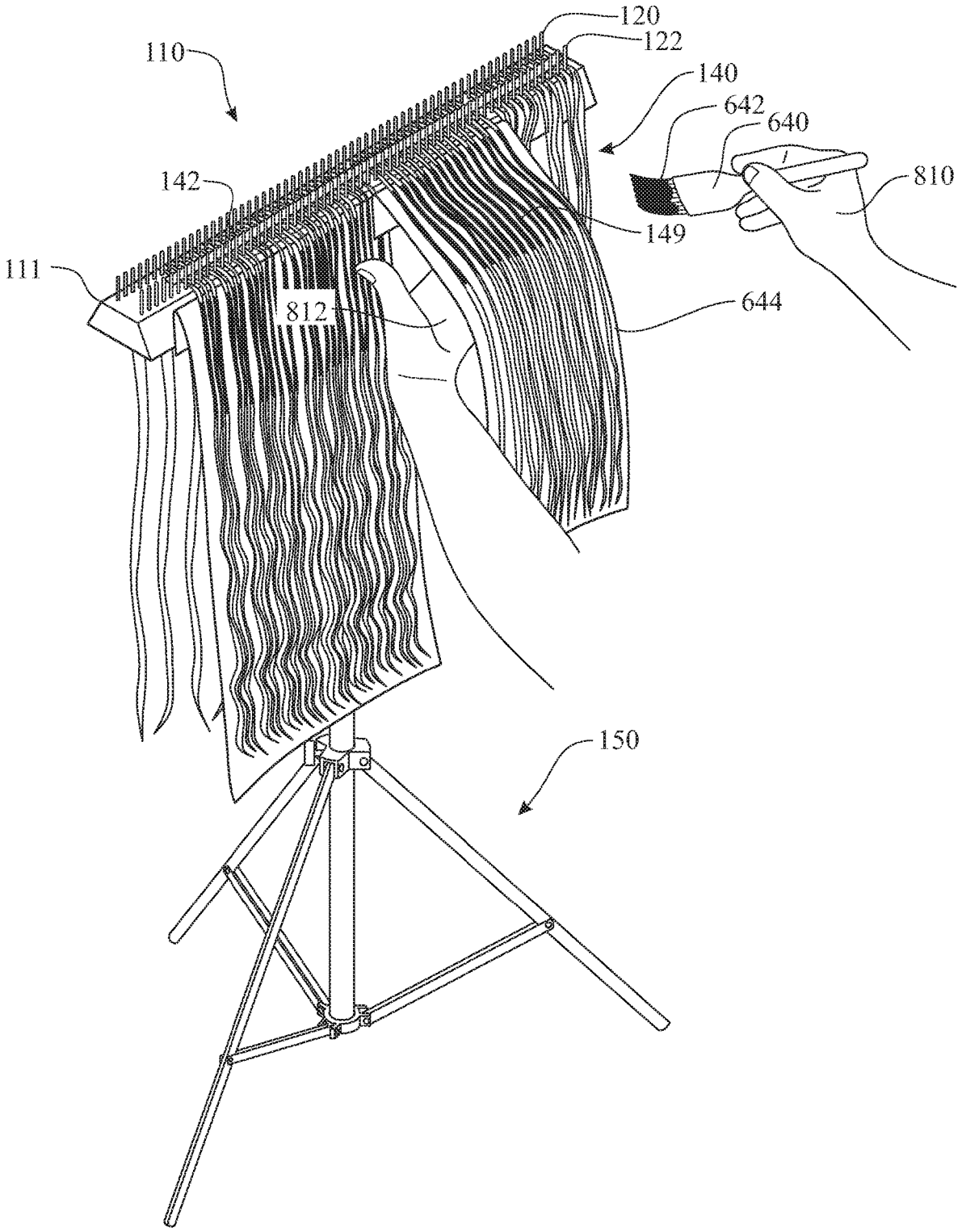
FIG. 14 presents an illustrative view of the first exemplary hair extension bar comb tool originally introduced in FIG. 1, wherein the drawing illustrates yet another exemplary use of the first exemplary hair extension bar comb tool enabling a hair stylist to color the hair extensions, while the hair extensions and hair coloring backing sheets are supported by the first exemplary hair extension bar comb tool.
Figure 15:
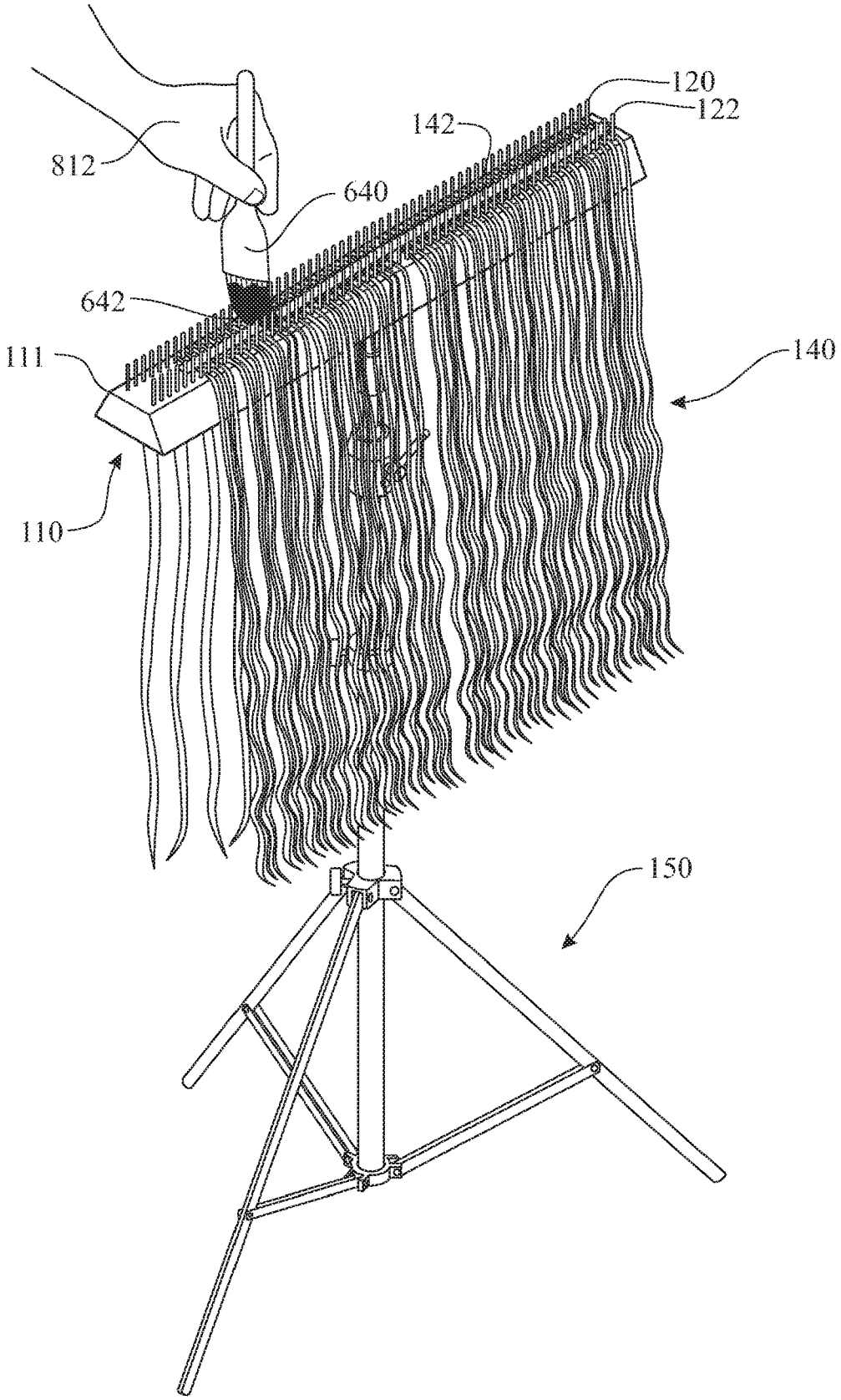
FIG. 15 presents an illustrative view of the first exemplary hair extension bar comb tool originally introduced in FIG. 1, wherein the drawing illustrates yet another exemplary use of the first exemplary hair extension bar comb tool enabling a hair stylist to color a base portions of the hair extensions, while the hair extensions, and more specifically, the base portions of the hair extension are supported by the first exemplary hair extension bar comb tool.
Figure 16:
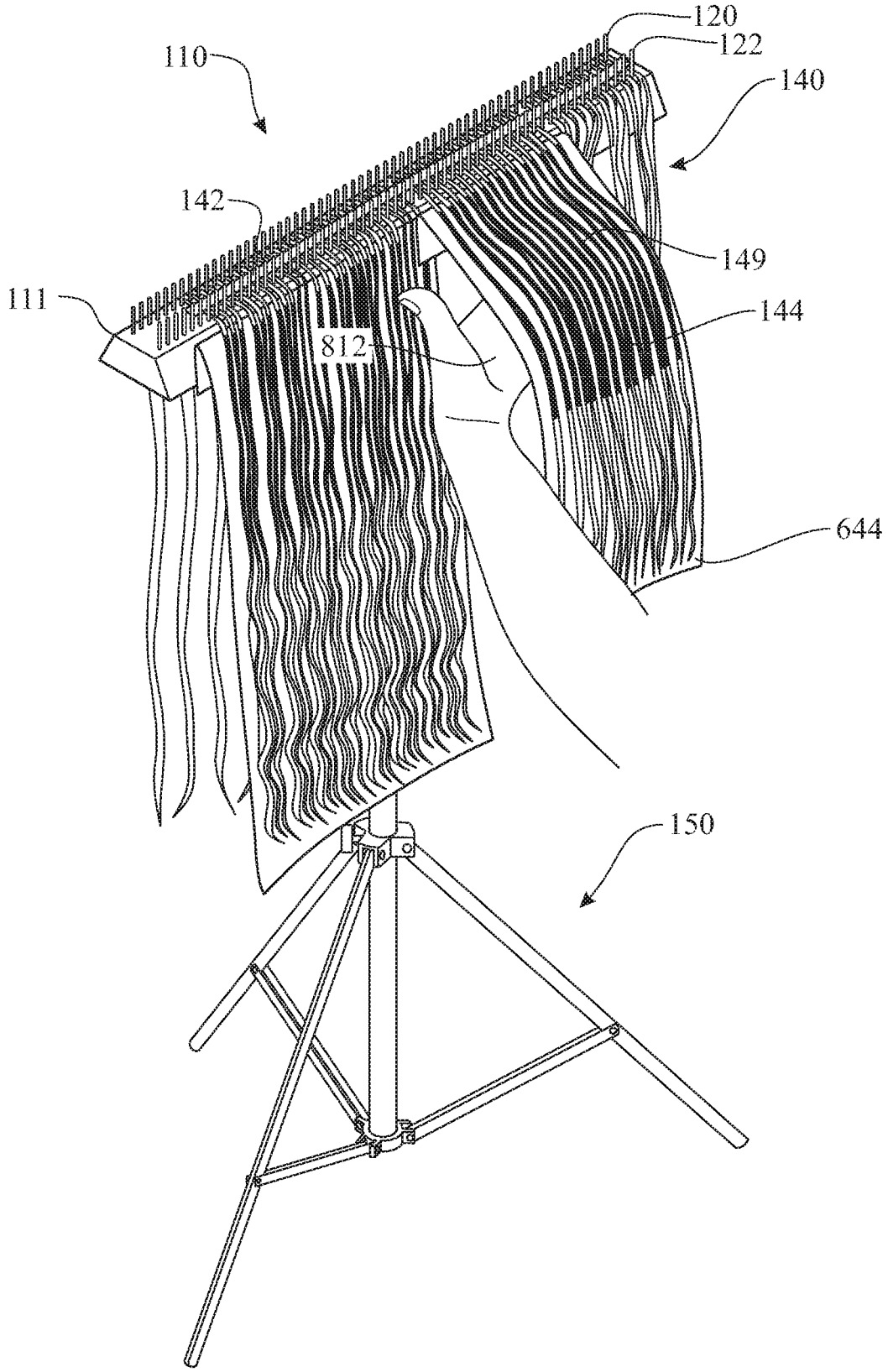
FIG. 16 presents an illustrative view of the first exemplary hair extension bar comb tool originally introduced in FIG. 1, wherein the drawing illustrates yet another exemplary use of the first exemplary hair extension bar comb tool enabling a hair stylist to color and highlight or provide multiple colors to the hair extensions, while the hair extensions and hair coloring backing sheets are supported by the first exemplary hair extension bar comb tool.

The hair extension bar comb tool 110 is a hair extension tool that allows the stylist 800 (FIG. 11) to organize placement, color and cut and style the hair extensions 140 while detached and before attachment or re-attachment to the client's head. The hair extension bar comb tool 110 is a stylist's assistant without hands. There are many times where the hair extensions 140 need to have a refresh tone applied or need to be re-colored or glossed or treated (color or other treatment 642 applied using a color applicator brush 640 as shown in FIGS. 14, 15, and 16) and then blow dried (blow dried using a hair blower 620 as shown in FIG. 12) after removal and before reinstallation on the client's head. This refresh/re-color and blow dry has become challenging for the stylist 800 and often requires two hands for the hair extension 140 and a third hand for the touch-up or colorization brush 640 and/or the blow drier 620. The hair extension bar comb tool 110 cuts refresh/re-colorization application time in half and produces an organized, clean system to keep the hair extension 140 in prime condition, that is, a de-tangled condition and gives the stylist 800 the freedom of creativity with color without a mess to clean up.

The hair extension bar comb tool 110 acts as a hair extension assistant without hands. There are six challenges in the hair extension industry and this hair extension bar comb system 110 provides a unique, inventive solution. Function: (a) color (FIGS. 14, 15, and 16) (providing colored hair 149), (b) rinse (FIG. 11) (providing washed hair 146). (c) blow dry (FIG. 12) (providing dried hair 147). (d) style (FIG. 13) (providing styled, such as curled hair 148), (e) organize the hair extension for re-placement and re-installation on the client's head; and (f) storage of the hair extension for future use and for compact organization of the finished hair extension 140 for the consumer or the stylist 800.

The hair extension bar comb tool 110 is an extension system with five unique attachments that attach to a customized base that allows the stylist 800 to organize placement, color (FIGS. 14, 15, and 16), cut and style (FIGS. 12 and 13) while the hair extension 140 is detached from the client's head.

As a hair extension artist, there are many times the challenge has presented itself where the client's hair extension 140 will need a refresh or tone not to mention recolor or a treatment (provided by applying color or other treatment 642). This is typically done during removal of the hair extension 140 because the hair extension 140 requires different treatment than the client's natural hair and usually requires two hands on stylist 800 to complete. Many times, with tape-in and keratin bond applications, there is left over hair and that hair will go unused due to color matching for other clients. This left over hair represents wasted money for the stylist 800 and the client. With the hair extension bar comb tool 110 and the hair extension storage bag 530 (FIGS. 9 and 10), this is no longer an issue. The stylist 800 will be able to use unused hair on a variety of people because they will now have the freedom to color the leftover hair (colored hair 149) to match their next client.

The components of the hair extension bar comb tool 110 are generally classified as follows: a customized base attachment that fits onto a mannequin head stand. One 22-inch double sided, comb-like bar (bar 111 with comb teeth rows 120, 122, (FIG. 1)) with a 1-inch flat center work region 127 on top surface 126. As shown in FIG. 7, hair extension bar comb tool 110 will attach to base attachment. A second configuration of the hair extension bar comb is a 14-inch double sided, comb-like bar (bar 111 with comb teeth rows 120, 122, (FIG. 1)) with a 1-inch flat center work region 127. The bar 111 that attaches to a base and stem attachment (FIG. 7). A third configuration is a 10-inch double sided, comb-like bar with a 1-inch flat work center region 127. A fourth configuration is a collapsible placement tool which consists of 18-inch full circular comb, 22 inch full circular comb, an 11 inch and 9 inch half-moon comb. These will all connect and collapse for storage. A wig/toupee attachment with a 22 inch circular comb and a solid dome center for stability is another configuration.

As shown in FIG. 1, hair extension bar comb tool 110 has a comb bar or base 111 with two rows of comb teeth 120, 122 spaced apart and defining a working region 127 on a top surface 126 of the bar 111. A short lateral working region 125 defines the periphery of the top surface 126 between comb row 122 and the edge defining top surface 126 and sloped surface 114. A similar short lateral surface is found to the right of comb row 120 and the right edge of surface 126 and slope 112. Slopes 112, 114 define a third working region or working surface.

Figure 5:
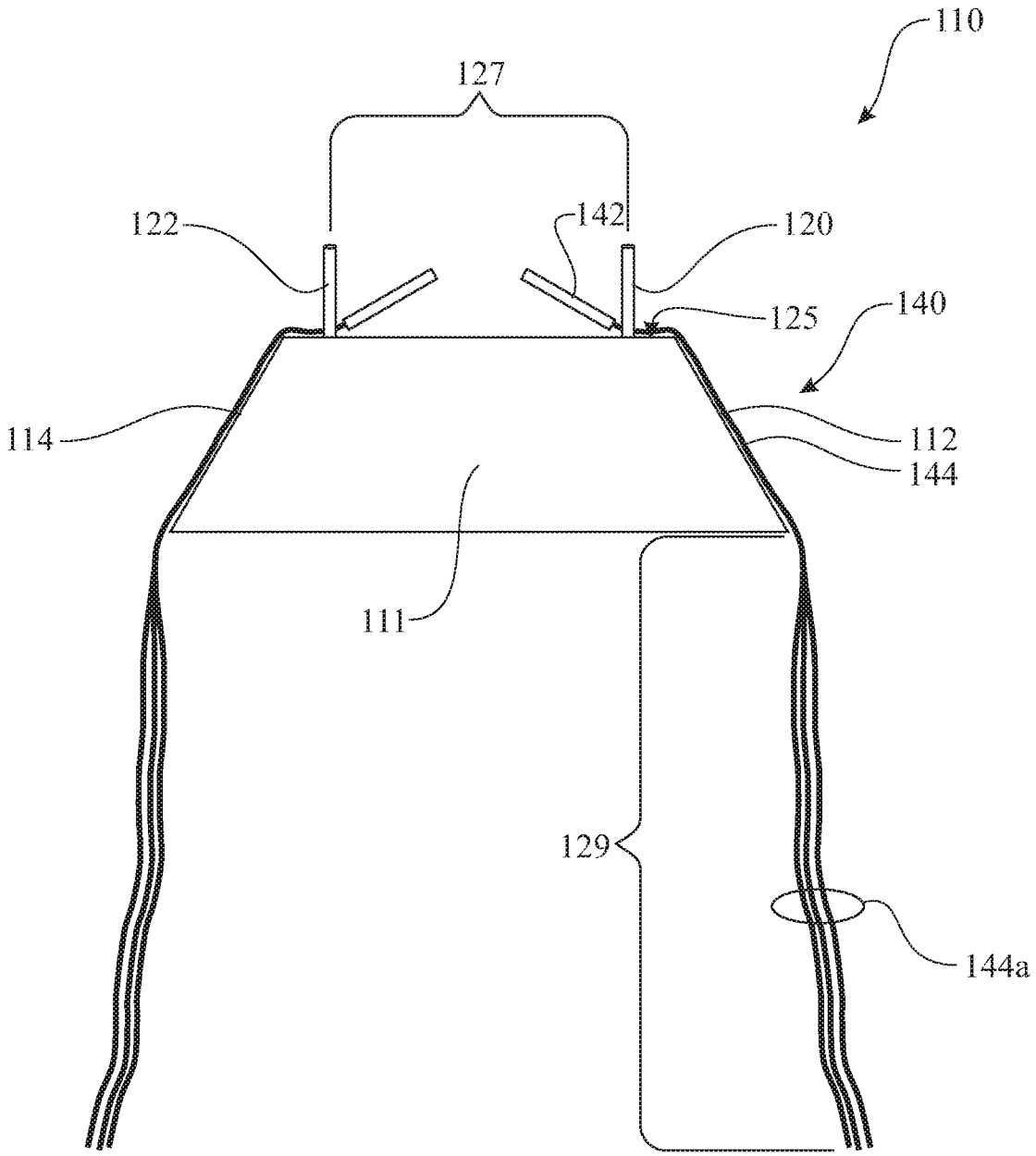
FIG. 5 presents an end view of the first exemplary hair extension bar comb tool originally introduced in FIG. 1, wherein the drawing illustrates how hair of the hair extension lays against and is supported by a sidewall of the first exemplary hair extension bar comb tool.
Figure 6:
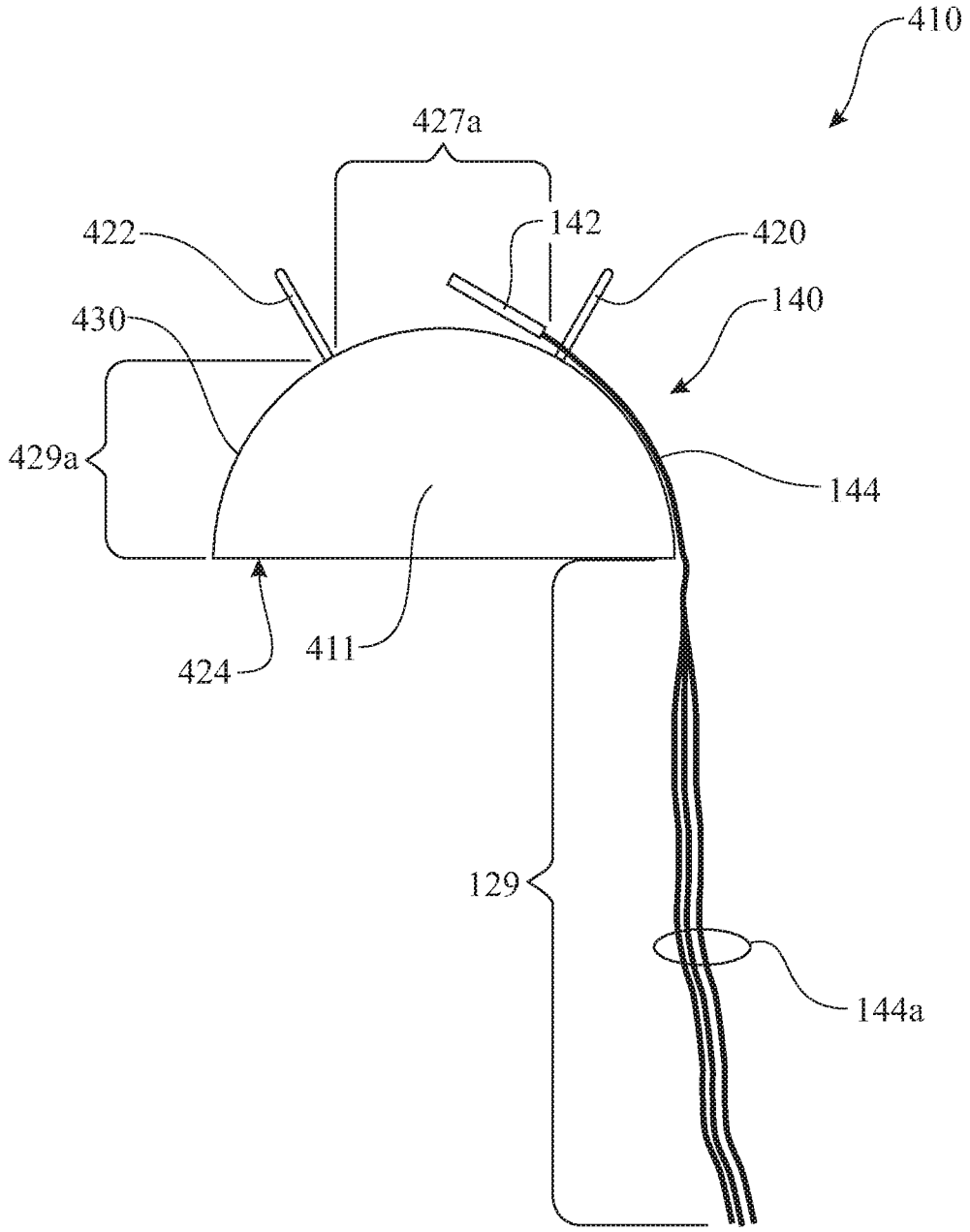
FIG. 6 presents an end view of a fourth exemplary hair extension bar comb tool having another alternative cross-sectional shape, wherein the drawing illustrates how hair of the hair extension lays against and is supported by a sidewall of the forth exemplary hair extension bar comb tool.

FIG. 4 diagrammatically illustrates a double sided version of a hair extension weft 144 centered on flat working region 126 between comb rows 120, 122. Similarly, FIG. 5 diagrammatically illustrates two single sided versions of hair extension wefts 144, each having the hair weft braid or the weft carrier 142 located within the flat working region 127 between comb rows 120, 122. Similarly. FIG. 6 diagrammatically illustrates a single sided version of hair extension weft 144, having the hair weft braid or the weft carrier 142 located within a working region 427*a* between comb rows 420, 422 of the hair extension bar comb tool 110.

In FIG. 4, the distance between each comb tooth and the serially adjacent comb tooth is exaggerated to show that extension hair 144 is laid in a gap 121 provided between adjacent comb teeth. Two hairs 144*a* are diagrammatically illustrated to show the utility of the flat working region 127 on top surface 126, the short side-lateral working regions and the slope 114. In use, the density of the hair falling from hair extension weft carrier 144 is too dense to show in the line drawings of this disclosure. In FIG. 4, the extension hair is placed in both rows of comb teeth 120, 122; however the extension hair may be placed in either comb teeth row 120 or comb teeth row 122. Sometimes, pins are needed to affix hair extension weft carrier 144 to the top surface 126.

The illustration presented in FIG. 5 demonstrates how the sloped sides 112, 114 backs or supports the strands of hair 144*a* of the hair extension 140. The support provided by the sloped sides 112, 114 enables the hair stylist 800 to apply pressure to the hair strands 144*a*.

The illustration presented in FIG. 6 demonstrates how an arched side surface 430 of a another exemplary comb tool 410 backs or supports the strands of hair 144*a* of the hair extension 140. The fourth exemplary comb tool 410 includes a hair extension bar/platform 411 having an arched upper surface (preferably semicircular) 430 and a generally planar bottom surface 424. The fourth exemplary comb tool 410 includes a pair of comb teeth 420, 422 extending radially outward from the arched upper surface (preferably semicircular) 430. A circumferential distance between comb rows 427*a* extends between each of the first set of comb teeth 420 and the second set of comb teeth 422. A portion of the arched upper surface (preferably semicircular) 430 extending downward from each of the comb teeth 420, 422 defines a slope 429*a*. The support provided by the slope portion 429*a* of the arched upper surface (preferably semicircular) 430 enables the hair stylist 800 to apply pressure to the hair strands 144*a*.

The flat working region 127 is needed to color (or re-color) or otherwise treat the extension hair near the hair extension weft 144. A "hair extension weft" 144 is generally defined as: "Machine wefted or machine weft hair extensions refer to products which have been sewn or 'wefted' to create the bundle of extensions. Loose or 'bulk' hair is fed through a triple-head sewing machine to add a reinforced stitch near the top (root) of the individual strands." See "Hair Extension Types—Indique Hair" at <https://www.indique-hair.com/hair-extensions-types.html> (captured Mar. 11, 2019); see also "WHAT ARE WEFT HAIR EXTENSIONS?Weft hair extensions are traditionally known as 'machine weft' which is one long piece of hair extensions which is sewn together." at <https://www.humanhairextensiononline.com.au/blog/what-are-weft-hair-extensions/> (captured Mar. 11, 2019). A "weft" 144 in the fabric industry is defined "(in weaving) [as] the crosswise threads on a loom over and under the warp threads to make cloth. [As in] 'weft threads'. Oxford online dictionary at <https://en.oxforddictionaries.com/definition/weft> (captured Mar. 11, 2019).

Stylists 800 may or may not distinguish machine-made hair extension wefts 144 with skin injection hair wefts 144. However, all these hair extension wefts 144 need to be color-matched to the client's desired hair style. Hence, the need for coloring or re-coloring close to the hair extension carrier 142, whether that carrier 142 is polyurethane or keratin or a weft woven carrier, as shown in the exemplary illustration presented in FIG. 15.

Therefore, the hair extension bar comb tool 110 provides a flat surface at work region 127 such that the stylist 800 can carefully apply color or other treatment 642 to the extension hair near and adjacent the weft 144 or extension carrier 142 using a color applicator brush 640, as shown in the exemplary illustration presented in FIG. 15. Further, if the weft 144 or carrier 142 is not pinned down to the top surface 126, the stylist 800 can pull the weft 144 or carrier 142 closer to one comb row 120, 122 compared to the other comb row 122, 120. In this manner the color application is uniformly applied over the length of the hair extension 140 by a simple "pulling left" action by the stylist 800 or a simple "pulling right" action by the stylist 800. In FIG. 4, the dots represent further hairs from weft or carrier 144.

The sloped working region 114 and, to some extent, the flat lateral side region 125, permits the stylist 800 to better and more easily apply color or treatment to the remaining length of extension hair falling from the hair extension bar comb tool 110. The obtuse angle 16*a* (FIG. 1) greatly improves the application of color or other treatments 642 (FIGS. 14, 15, and 16). Further, extension hair strands 129 falling off beyond a lower edge of the slope 114 can be easily colored or treated by the stylist 800 using one hand (illustrated as the second hand 812) behind the falling or unsupported hair strands 129 and the other hand (illustrated as the first hand 810) holding the color applicator brush 640 (FIGS. 14, 15, and 16). In this sense, the hair extension bar comb tool 110 mimics the hair falling off the client's head. In FIGS. 4 and 5, hair strands 144*a* are shown only to illustrate that the stylist 800 can flatten out the hair strands 129 falling over slope 114 to achieve nearly a one-on-one hair treatment. Of course, the slope 112 acts in the same manner as the slope 114.

It should be noted that the hair extension weft 144 need not be passed through both comb rows 120, 122. Instead, all the strands of extension hairs from the hair weft 144 can be placed through a single comb row 120 for color or other treatment 642, as illustrated in FIGS. 5 and 6.

Figure 11:
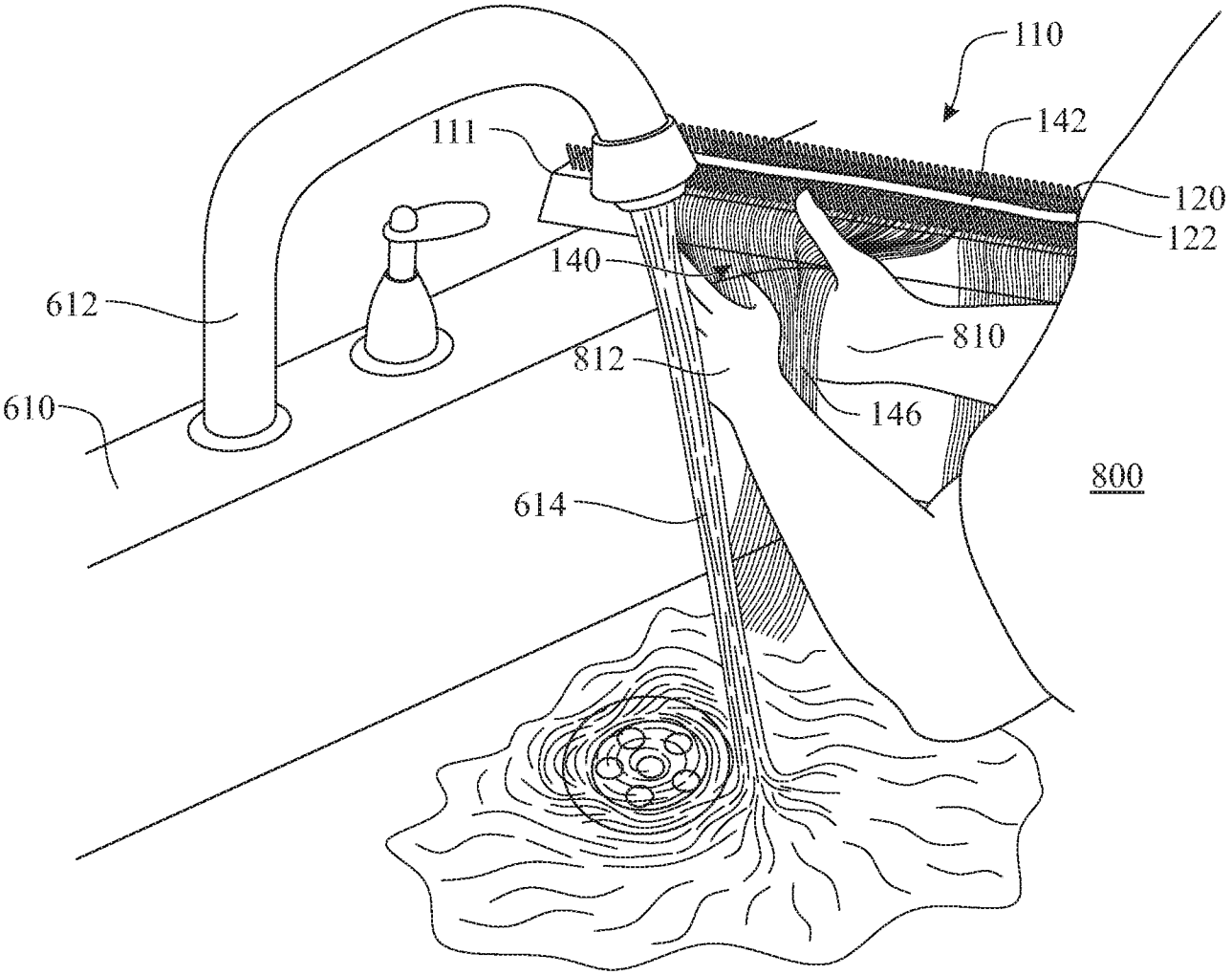
FIG. 11 presents an illustrative view of the first exemplary hair extension bar comb tool originally introduced in FIG. 1, wherein the drawing illustrates an exemplary use of the first exemplary hair extension bar comb tool enabling a hair stylist to wash the hair extensions, while the hair extensions remain supported by the first exemplary hair extension bar comb tool.
Figure 12:
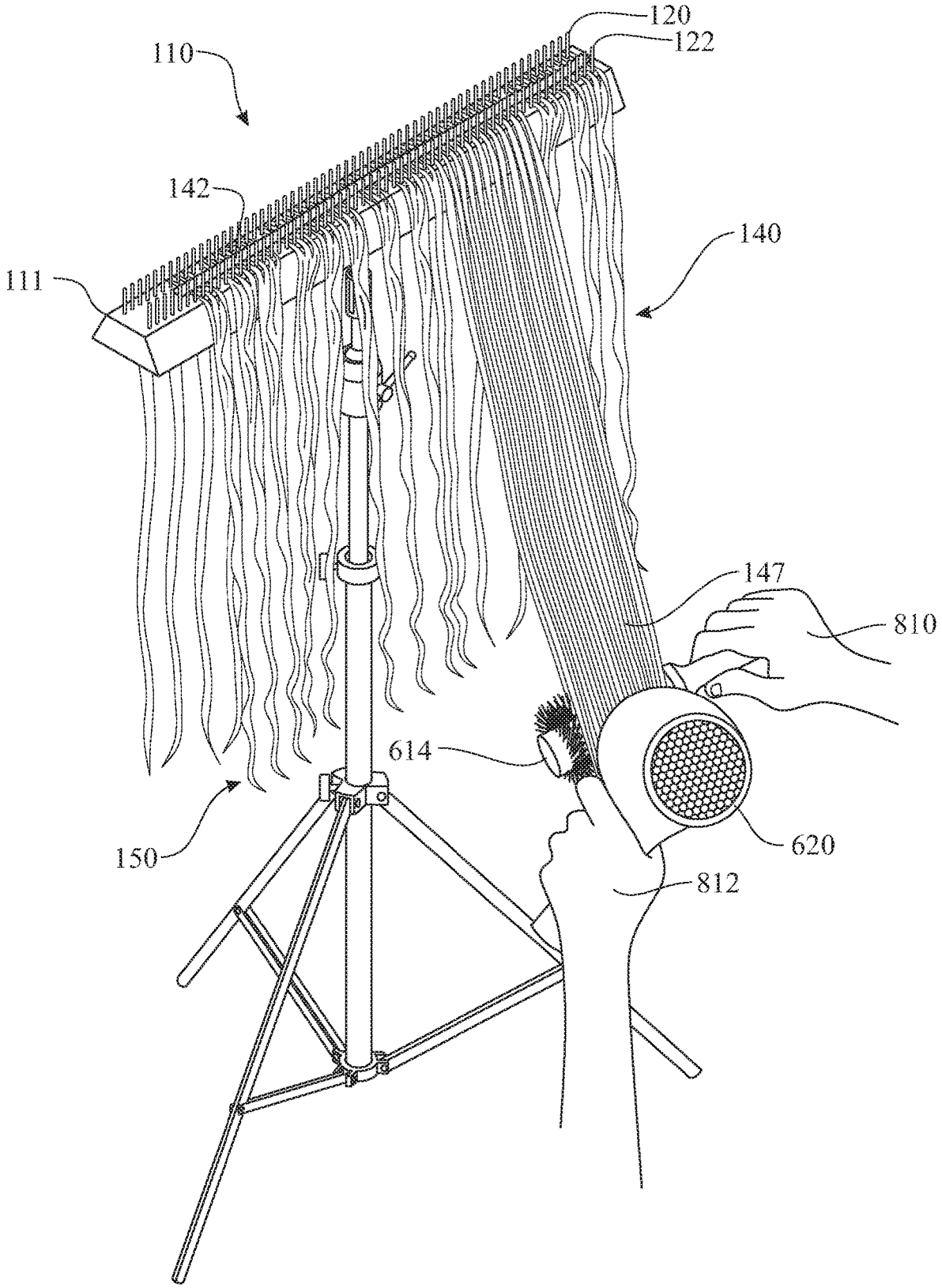
FIG. 12 presents an illustrative view of the first exemplary hair extension bar comb tool originally introduced in FIG. 1, wherein the drawing illustrates another exemplary use of the first exemplary hair extension bar comb tool enabling a hair stylist to blow dry the hair extensions, while the hair extensions remain supported by the first exemplary hair extension bar comb tool.

In addition to color treatments 642, the hair extension bar comb tool 110 is used to wash the strands of hair 144*a* of the mounted hair extension 140 in a sink or tub 610, as illustrated in FIG. 11. The stylist 800 de-couples the hair extension bar comb tool 110 from the stand 150, 160 (see stand in FIG. 7 or FIG. 8) and places the hair extension bar comb tool 110 over a corner of the sink or tub 610. The strands of hair 144*a* of the hair extension 140 then fall into the sink 610 and the stylist 800 washes the strands of hair 144*a* of the hair extension 140 in the sink 610 using water 614 flowing from a faucet 612.

To dry the strands of hair 144*a* of the hair extension 140, the stylist 800 may re-mount the hair extension bar comb tool 110 onto the stand 150, 160 (or clamp the stand stem 163 on a table or shelf 720) and blow dry the hair extension 140, as illustrated in FIG. 12. One hand 810, 812 of the stylist 800 holds a hair blower 620, drying hair 147, while the other hand 812, 810, of the stylist 800 holds open the strands of hair 144*a* of the hair extension 140 or uses a hair brush 814, drying hair 147. Further the stylist 800 can comb out the strands of hair 144*a* of the hair extension 140 mounted on the hair extension bar comb tool 110 without difficulty, such as by using a comb or the hair brush 614.

Figure 13:
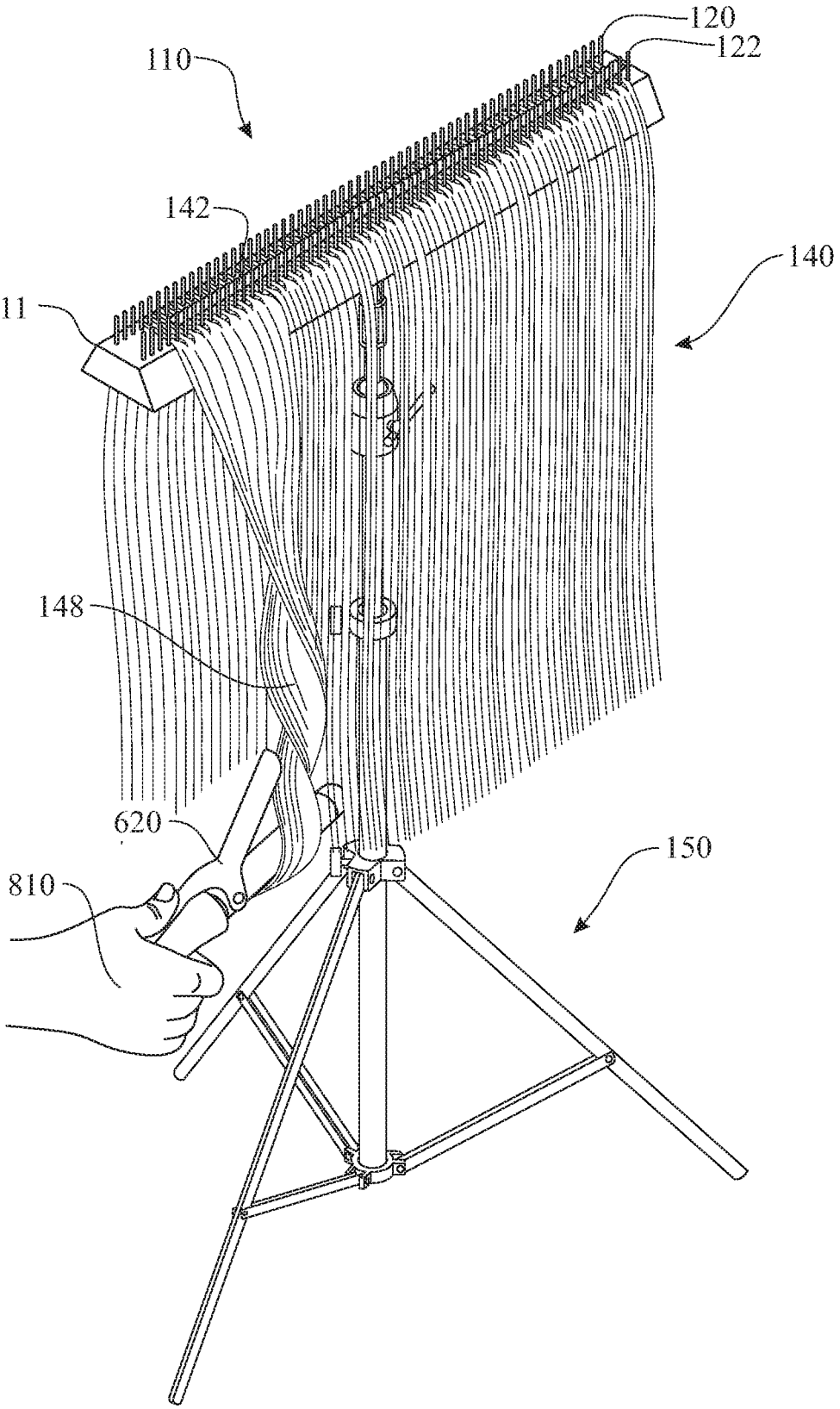
FIG. 13 presents an illustrative view of the first exemplary hair extension bar comb tool originally introduced in FIG. 1, wherein the drawing illustrates yet another exemplary use of the first exemplary hair extension bar comb tool enabling a hair stylist to curl the hair extensions, while the hair extensions remain supported by the first exemplary hair extension bar comb tool.

Similarly, the strands of hair 144*a* of the hair extension 140 can be styled using a curling iron 630, as illustrated in FIG. 13, creating styled hair 148. The hair extensions 140 are supported by the comb tool 110 mounted to the stand (such as the stand illustrated in FIG. 7 or FIG. 8), freeing up both hands of the hair stylist 800 to form curls in the strands of hair 144*a* of the hair extensions 140 using the curling iron 630.

Some hair colorization uses portions of the strands of hair 144*a* of the hair extension 140 placed atop wax paper 644, as illustrated in FIG. 14. With the hair extension bar comb tool 110, the wax paper 644 is secured to or placed on either or both slopes 112, 114, a small segment of strands of hair 144*a* is drawn over the wax paper 644 and the stylist 800 colors (adding color or other treatment 642) the segmented hair thereon, commonly accomplished by using a color applicator brush 640. Multiple sheets of wax paper 644 are secured to the sloped surface 112, 114 or sloped surfaces 112, 114 which the stylist 800 will be placing over or already having the hair extensions 140 laying over. Using multiple sheets of wax paper 644 secured to the sloped surfaces 112, 114 enables the stylist 800 to separate a portion of the hair strands 144*a* from the entire set of hair strands 144*a* of the hair extensions 140 and apply color or other treatment 642 to that section without interference from other sections of the hair extension 140.

In certain applications, the customer may desire having multiple colors, highlights, etc. (provided by applying color or other treatment 642) applied to the hair extensions 140, thus coloring hair 149. The hair extension bar comb 110 eases the process of applying multiple colors, highlights, etc. (provided by applying color or other treatment 642) to the hair extensions 140, as illustrated in FIG. 16.

FIG. 7 diagrammatically illustrates one stand mount 150 for hair extension bar comb tool 110. Other mount systems, such as the stand 160 (FIG. 8) may be used. The bottom or lower surface 124 of the hair extension bar comb tool 110 can include a mounting coupler 139 that mates with a complementary top stem coupler unit 151. A height adjustment control 152 is a rotation-type grip lock which can be rotated to permit the stylist 800 to raise or lower the hair extension bar comb tool 110. Stem segments slide within each other. A lower stem 155 is movably mounted beneath a stem segment 153 with a second rotation-type height adjustment control 154. Tripod legs 156 illustrate one of the many stable floor stands 150 that may be used with the hair extension bar comb 110.

As an alternative to the tripod of the floor or table stand 150 may include a clamp based stand 160, which permits the stylist 800 to mount the hair extension bar comb tool 110 to a table or shelf 720, as illustrated in FIG. 8. See, for example, clamps in the U.S. Pat. No. 286662; and U.S. Pat. No. 6,585,207. An exemplary table mount assembly 160 includes a complementary top stem coupler unit 161 for securing the clamp to the bar coupler 139. A table mounted support assembly for the hair extension bar comb tool 110 includes a complementary top stem coupler unit 161 pivotally supported by a ball joint 164. The table mounted support assembly is secured to an edge of a table top, desktop, countertop (collectively represented by 720), and the like by a clamping system. The clamping system can include an upper clamp member 166 and a lower clamp member (not shown). The upper clamp member 166 and the lower clamp member are drawn together by a clamp pressure applicator 167. The ball joint 164 pivots within a ball joint receptacle 165. Once properly positioned, the ball joint 164 is retained in position within the ball joint receptacle 165 by a clamping force provided by a ball joint compression applicator 168. The complementary top stem coupler unit 161 can be adjusted to different heights by a sliding the stand stem 163 to a desired height and locking the stand stem 163 in position by tightening a height adjustment control 162.

Figure 2:
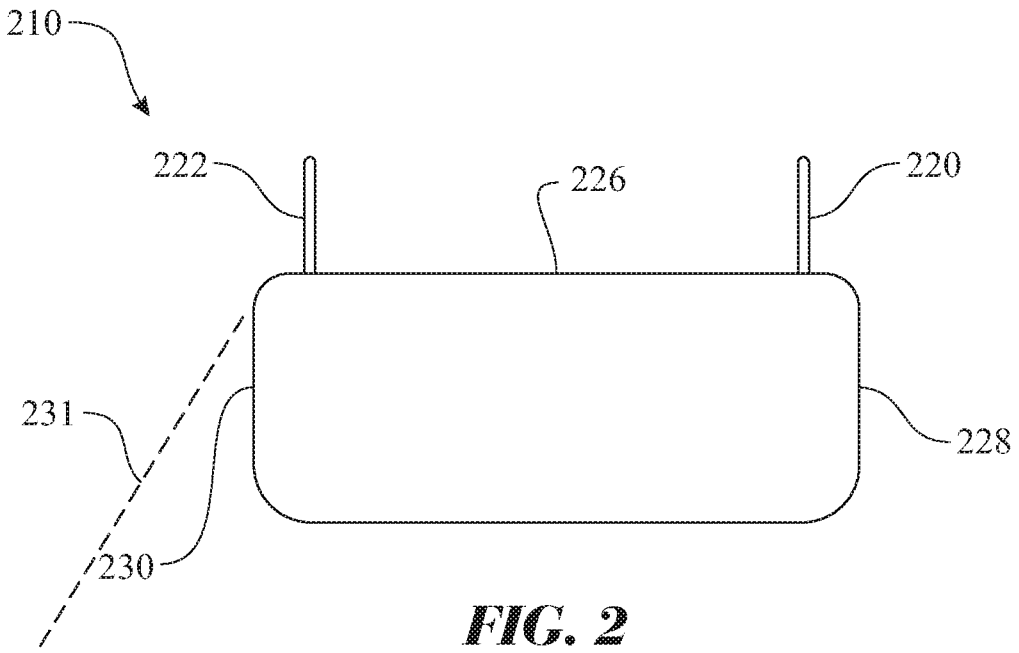
FIG. 2 diagrammatically illustrates an end view of a second exemplary hair extension bar comb tool having an alternative cross-sectional shape.
Figure 3:
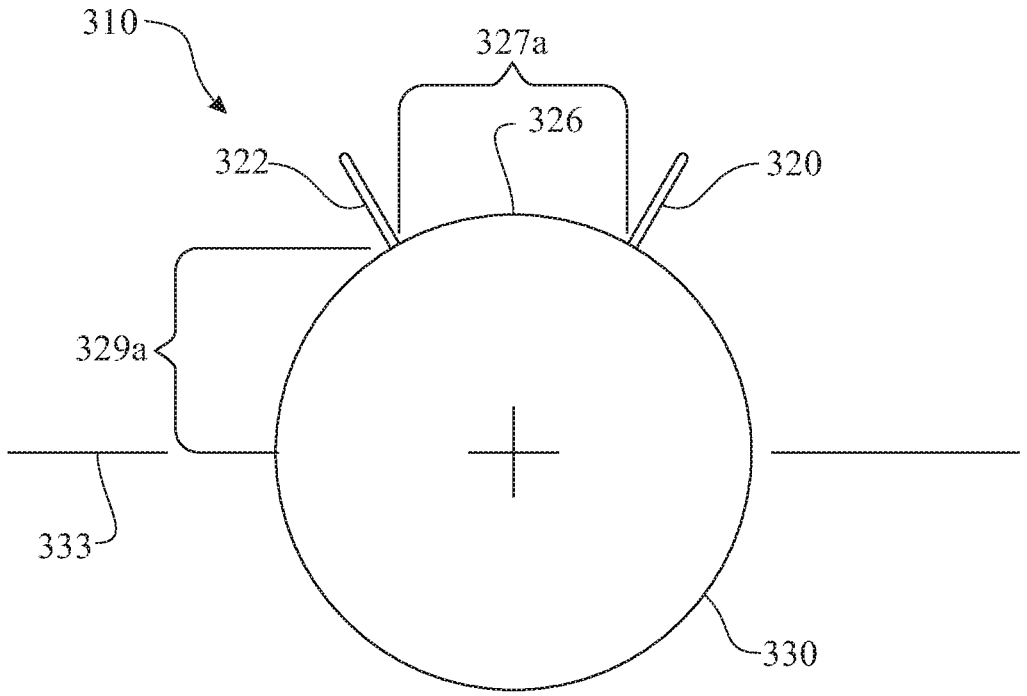
FIG. 3 diagrammatically illustrates an end view of a third exemplary hair extension bar comb tool having another alternative cross-sectional shape.

FIGS. 2 and 3 diagrammatically illustrate alternative cross-sectional shapes for the hair extension bar comb 110. As an alternative to the quadrilateral or trapezoidal shape of the hair extension bar comb tool 110 in FIG. 1 (an isosceles trapezoid shape), a hair extension bar comb tool 210 is introduced in FIG. 2. Like elements of the hair extension bar comb tool 110 and the hair extension bar comb tool 210 are numbered the same, whereas the elements of the hair extension bar comb tool 210 are preceded by the numeral "2". The hair extension bar comb tool 210 is formed having cross section shape in a form of a rectangle with sides 228, 230 at right angles (90 degrees) to the top surface 126 or extending downward from the top surface 126. However, the absence of a slope 131 (dashed lines), referring to the sloped sides 112, 114 of the hair extension bar comb tool 110, may reduce the efficiency of the coloring task (adding color or other treatment 642) of the stylist 800 because the stylist 800 needs to pull out the hair away from the side 230. In another alternative to the quadrilateral or trapezoidal shape of the hair extension bar comb tool 110 in FIG. 1 (an isosceles trapezoid shape), is a circular or partly elliptical cross-sectional shape 330, which is introduced in FIG. 3. Like elements of the hair extension bar comb tool 110 and the hair extension bar comb tool 310 are numbered the same, whereas the elements of the hair extension bar comb tool 310 are preceded by the numeral "3". As for the circular or partly elliptical cross-sectional shape 330 variant of the hair extension bar comb tool 110, introduced in FIG. 3, the upper circumference (above mid-line 333) of the hair extension bar comb defines a reasonably large work region 327*a* to capture the hair weft braid 144 or the weft carrier 142, then the upper hemisphere of the hair extension bar comb in FIG. 3 may work reasonably efficiently. The circumferential distance 327*a* between comb rows 320, 322 should be adequately large to capture the hair weft braid 144 or the weft carrier 142 therebetween. The slope 329*a* may be adequate to permit the stylist 800 to apply color or treatment 642 to hair strands 144 of the extension hair 140 near, but not adjacent the hair weft braid 144 or weft carrier 142. A hemispherical shape may also be used if FIG. 3 is bisected at mid-line 333. It is understood that the hair extension bar comb tools 210, 310, 410 can be supported by either of the stands/supports 150, 160 illustrated in FIGS. 7 and 8. The stylist 800 can use the hair extension bar comb tools 210, 310, 410 in the same manner as the processes described herein using the hair extension bar comb tool 110.

The lower surface 124 of hair extension bar comb tool 110 need not be parallel to upper surface 126. Although there is a benefit associated with a flat lower surface 124 when the stylist 800 washes the hair extension mounts on bar/platform Ill and when the stylist 800 carries the bar/platform 111, the lower surface 124 could be shaped in any form or manner.

The hair extension bar comb tool 110 can be made out of any durable material. The double set of comb teeth 120, 122 extend upward in a direction that is generally perpendicular to the upper flat surface 126 of the bar/platform 111. The sloped side surfaces 112, 114 depend from the upper flat surface 126 of the bar/platform 111 and arc angled to permit the stylist 800 or user to color (provided by applying color or other treatment 642) the hair 144 or blow dry the hair 144 using a hair blower 620. The hair extension bar comb tool 110 has, at its midpoint on the lower parallel flat surface 124, a coupling joint 139 which cooperates with the downward extending stem 151.

As indicated above, the hair extension bar comb tool 110 includes an elongated base 111, of various cross-sectional shapes (quadrilateral, a trapezoidal, isosceles trapezoidal, circular, hemispherical elliptical and hemispherical elliptic; see FIGS. 1-3) wherein two comb teeth rows 120, 122, in parallel with each other, capture extension hair from a hair extension 140 on at least a portion of teeth of one of the comb teeth rows 120, 122 (FIG. 4). As discussed, all strands of hair 144*a* of the hair extension 140 may pass through gaps between adjacent teeth of one of the comb teeth row 120, 122 and captured by one portion of one comb teeth row 120 (FIG. 4 shows two-way hair capture (rows 120, 122), but one-way hair capture (row 120) operates the same). A flat top surface 126 is helpful, but gentle curved surfaces 326 (FIG. 3), with sufficient top working region 327*a*, may also provide similar operational benefits discussed herein. The substantially flat top surface optimally has a lateral working region span of between about 0.5 inches and 4.0 inches, and typically about 1.5 inches. Sloped sides are operationally helpful and optimally provide a sloped working region of between about 0.5 inches and about 4.0 inches, and typically about 1.0-1.5 inches. The objective achieved by the parallel, spaced apart comb teeth rows 120, 122 is to provide a coloration process platform, which is working region 127, therebetween. Additionally, the sloped working region 112, 114 provides an additional coloration process platform.

Figure 9:
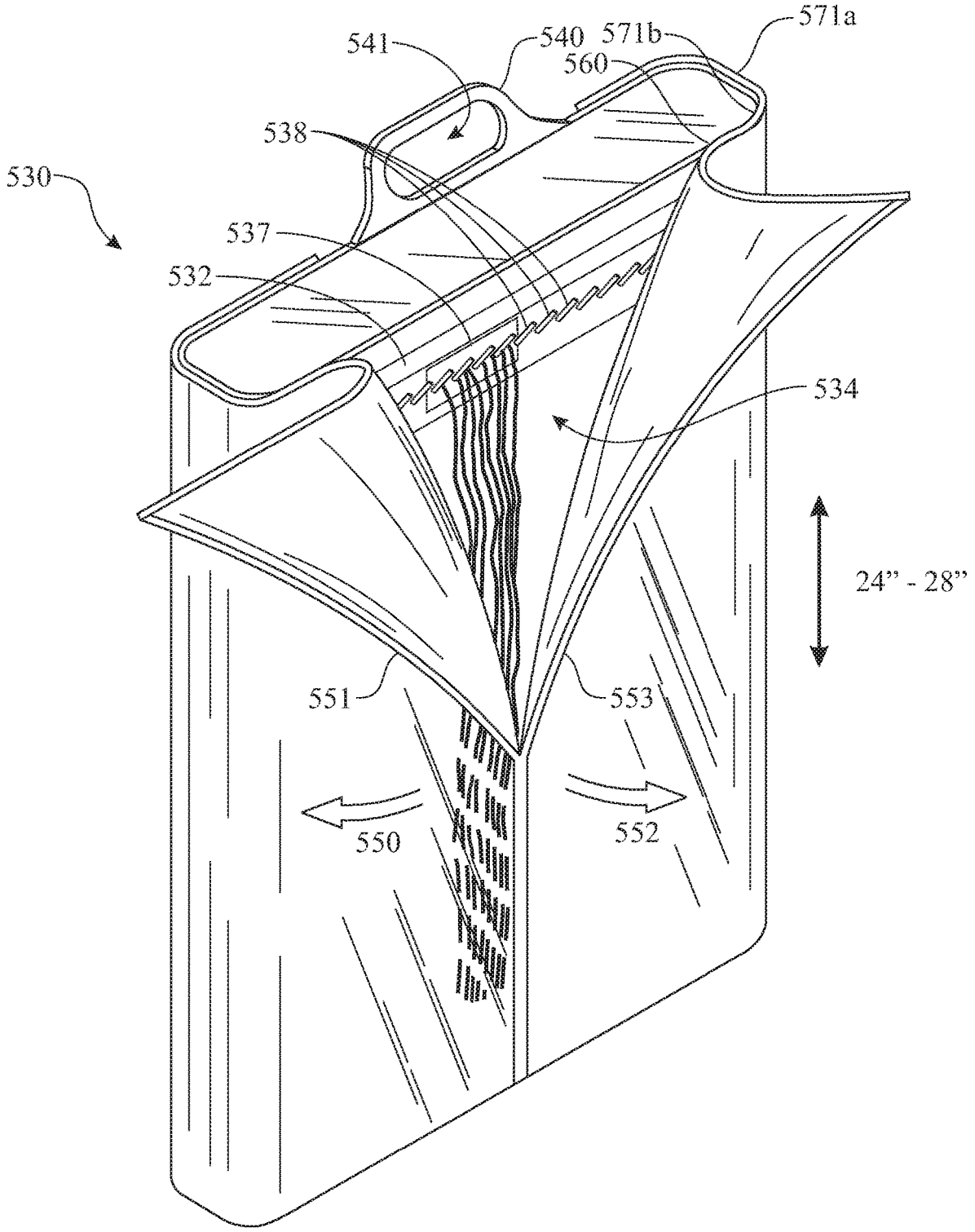
FIG. 9 presents an isometric front view a storage bag with an interior comb hanger shown in a partially opened configuration.
Figure 10:
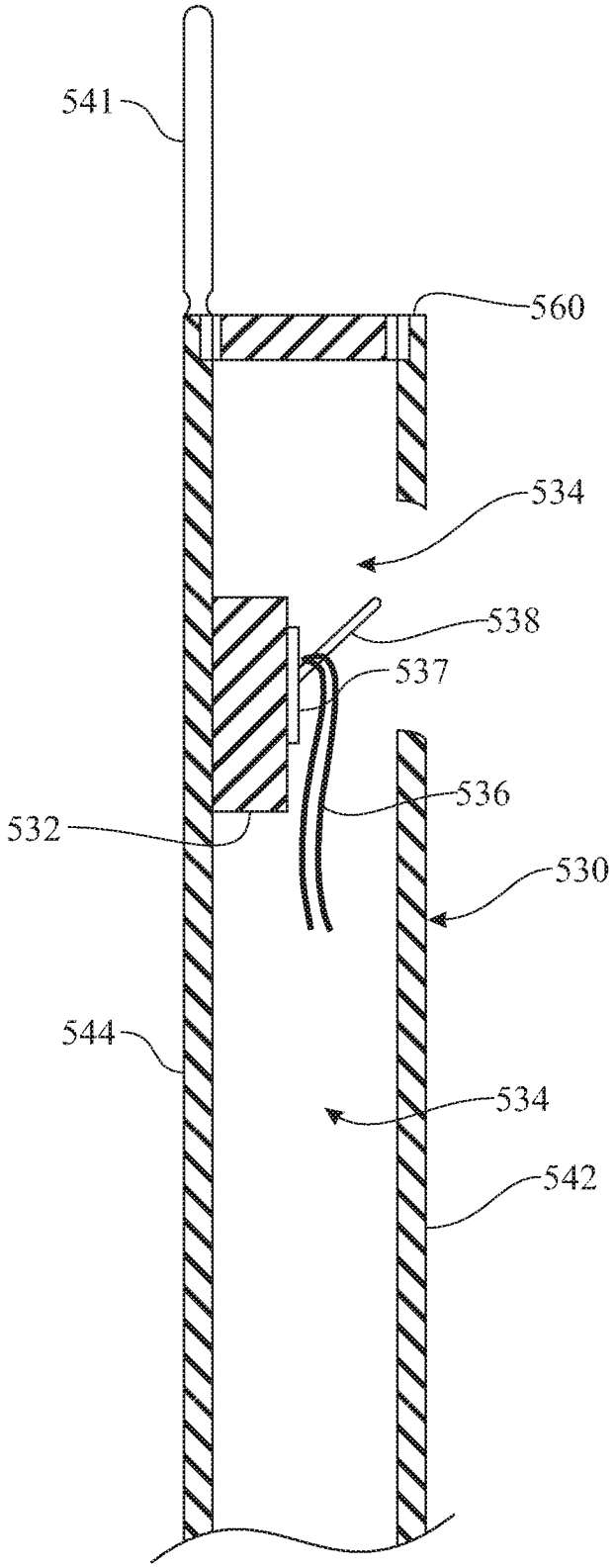
FIG. 10 presents a sectioned side view of the storage bag originally introduced in FIG. 9.

FIGS. 9 and 10 diagrammatically illustrate a storage bag for hair extensions comprising strands of hair 536 extending from a hair extension carrier 537. These figures are discussed concurrently herein. The storage bag 530 for the hair extension 536, 537 shows that extension hair 536 falls down into the bag 530 from an interior comb hanger 532 and into a vertical bag cavity 534 (which may be 24-28 inches in depth). The storage bag 530 has a generally transparent front vertical panel, with a vertical closure system 551, 553, preferably a dense hook and loop tape, male and female cloth closure system. Alternatively, a tongue and groove vertical closure system 551, 553 may be used, similar to the ZIP-LOK™ closure system. A zipper closure 550, 552 may also be used.

FIGS. 9 and 10 show storage bag 530 with an interior comb hanger 532. Hair extensions 536, 537 are shown extending into the inboard or interior cavity 534. Near the top edge of bag 530, a substantially horizontal comb hanger 532 is mounted on the inside surface of bag 530. Comb hanger 532 includes a single row of comb teeth 538. The teeth are mounted at an acute angle from the operational surface of the interior bar (about 70-80 degrees). The teeth either horizontally extend from the horizontal bar 532 (normal to the vertical bag cavity) or at an acute angle with respect to the vertical bag cavity. The bag comb teeth may be at a 90 degree angle to the vertical surface of the hanger bar 532 or less than 90 degrees from the bar. The hair extension carrier 537 is mounted on these comb teeth 538. The comb teeth 538 generally extend the entire length of interior comb hanger 532.

In addition, extending above the upper closure system 560 (discussed later) is a tab or a flap 540 which includes an aperture 541 such that user can hang the storage bag 530 vertically and not adversely affect hair strands 536 extending from the hair extension carrier 537 hanging from the interior hanger bar 532 into the lower regions of cavity 534.

FIG. 10 shows a cross-sectional side view of the storage bag 530 and the interior comb hanger 532 and comb teeth 538. A closure system 560 closes the top of the storage bag 530. The hair strands 536 of the hair extension 536, 537, as shown in the drawing, hangs between the front-side bag layer 542 and the back-side bag layer 544. The closure system 560 may be a ZIPLOC™ type tongue and groove closure or interlocking tongue and groove system, a snap, a button or bar co-acting with slots or button holes, or a zipper or other type of closure system, such as a hook and loop cloth closure system (see VELCRO™ closures).

The storage bag 530 is about 24-28 inches long and enables the user to encase the hanging hair extensions 536, 537 in a depending generally flat condition within the storage bag 530.

The interior comb bar 532 carries a single set of comb teeth 538, where the teeth 538 are mounted at an acute angle with respect to the outboard facing surface of the interior bar 532. The outboard facing surface of the interior bar faces inboard into cavity 534 of the hair extension bag 530. The comb teeth 538 extend away from the bar's outboard facing surface.

The storage bag 530 can be utilized by stylists 800 and consumers. The stylist 800 can keep the left over hair extension(s) 536, 537 organized and tangle free and customized by color or client and not just thrown in a bag or bin. The consumer can store their hair extensions 536, 537 when un-used and choose to hang in closet for future use. This is ideal for clip-in hair extensions 536, 537 or the special occasion extension wearer. In today's market the hair strands 536 have become better quality and lasts longer from application to application. This increases the need to store the hair extensions 536, 537 instead of throwing away the hair extensions 536, 537. Hence the consumer saves money and gives stylists 800 the organization he or she needs when storing left over hair extensions 536, 537 for future use.

The storage bags 530 will be sold as a stylist 800 pack which would consist of levels 1-12 and can be purchased separately. For example, the bags may include 12 to-be-labeled bags with custom tabs for levels 2-12 on a large lockable ring-and-hook to hang the bags that organizes and stores unused extension hair 536, 537 for a future client. The labels can bear the name of the client. The hair designer will have the option to purchase more storage bags 530 if needed. The storage bags 530 can be sold separately for consumer to store clip ins etc. for future use. All attachments and parts of the system will consist of the comb like teeth 538 for convenience and organization.

REFERENCE CHARACTER DESCRIPTIONS

Ref. No. Description

110 comb tool
111 hair extension bar/platform
112 sloped side
114 sloped side
116*a* obtuse angle
116*b* lateral span (lower surface)
116*c* lateral span (top surface)
120 first set of comb teeth
121 gap between adjacent comb teeth
122 second set of comb teeth
124 lower surface
125 flat lateral side region
126 planar top surface
127 flat work center region
127*a* reasonably large work region
129 extension hair strands falling off beyond the a lower edge of the slope
131 slope
139 bar coupler
140 hair extension
142 hair weft braid or the weft carrier
144 hair extension weft carrier hair extension weft
144*a* two hairs
146 washed hair
147 dried hair
148 curled or styled hair
149 colored hair
150 floor or table stand assembly
151 complementary top stem coupler unit/floor or table stand
152 height adjustment control
153 stand stem
154 second rotation-type height adjustment control
155 lower stem
156 tripod legs
160 clamp based stand
161 complementary top stem coupler unit
162 height adjustment control
163 stand stem
164 ball joint
165 ball joint receptacle
166 upper clamp member
167 clamp pressure applicator
168 ball joint compression applicator
210 comb tool
220 first set of comb teeth
222 second set of comb teeth
226 top surface
228 side
230 side
231 slope
310 comb tool
320 first set of comb teeth
322 second set of comb teeth
326 top surface
330 side
333 mid-line
327*a* circumferential distance between comb rows
329*a* slope
410 comb tool
411 hair extension bar/platform
420 first set of comb teeth
422 second set of comb teeth

424 bottom or lower surface
427*a* circumferential distance between comb rows
429*a* slope
430 side surface
530 storage bag
532 interior comb hanger/interior comb bar
534 inboard or interior cavity
536 hair extension
537 hair extension carrier
538 single row of comb teeth
540 tab or flap
541 aperture
542 front-side bag layer
544 back-side bag layer
550 zipper closure
551 vertical closure system
552 zipper closure
553 vertical closure system
560 upper closure system
610 sink or tub
612 faucet
614 water
620 hair blower
622 hair brush
630 curling iron
640 color applicator brush
642 color or other treatment
644 wax or other backing paper
720 tabletop, desktop, countertop
800 stylist
810 stylist first hand
812 stylist second hand

The invention claimed is:

1. A method of supporting hair extensions, the method comprising steps of:

placing hair extensions into a hair extension bar comb assembly, the hair extension bar comb assembly comprising:

an elongated platform comprising a top working surface, the top working surface being substantially planar and extending laterally and continuously across a plane defined by top surfaces of a pair of elongated edges, and a pair of laterally spaced apart side surfaces, each side surface extending in one of (a) a direction substantially downward from each respective edge or (b) a direction generally downward and outward from each respective edge at an obtuse angle from a generally horizontal orientation, a first comb teeth row extending in a generally upward direction from a location on the elongated platform proximate a first elongated edge of the pair of elongated edges, the first comb teeth row extending in the generally upward direction from a position on the elongated platform that is one of (a) at the top working surface or (b) below the top working surface, and a second comb teeth row extending in a generally upward direction from a location on the elongated platform proximate a second elongated edge of the pair of elongated edges, the second comb teeth row extending in the generally upward direction from a position on the elongated platform that is one of (a) at the top working surface or (b) below the top working surface, each of the first comb teeth row and the second comb teeth row having a multiplicity of spatially arranged teeth, wherein at least a portion of the multiplicity of teeth in one of the first comb teeth row and second comb teeth row is adapted to capture strands of hair of the hair extension therebetween, positioning a bonded section of each hair extension at a location between the first comb teeth row and the second comb teeth row, where a first portion of strands of hair of the respective hair extension is positioned between two adjacent teeth of the first comb teeth row and a second portion of strands of hair of the respective hair extension is positioned between a different two adjacent teeth of the first comb teeth row and the bonded section of the respective hair extension rests against the top working surface located between the first comb teeth row and the second comb teeth row; and applying a hair processing treatment onto the bonded section of the respective hair extension.

2. A method of supporting hair extensions as recited in claim 1, wherein gaps between adjacent teeth of the first comb teeth row and gaps between adjacent teeth of the second comb teeth row are located at one of proximate or passing across the top working surface of the elongated platform, the method further comprising a step of:

positioning the first portion of strands of hair of the respective hair extension within the gap between two adjacent teeth of the first comb teeth row and resting a hair strand connecting element against the top working surface.

3. A method of supporting hair extensions as recited in claim 1, the method further comprising a step of:

positioning a third portion of strands of hair of the respective hair extension between two adjacent teeth of the second comb teeth row.

4. A method of supporting hair extensions as recited in claim 1, the method further comprising a step of:

applying at least one of a color and a treatment to the strands of hair of the hair extension while the hair extension is supported by the hair extension bar comb assembly.

5. A method of supporting hair extensions as recited in claim 1, the method further comprising steps of:

applying at least one of a color and a treatment to the strands of hair of the hair extension while the hair extension is supported by the hair extension bar comb assembly; and providing a backing support to the hair extension during the step of applying at least one of a color and a treatment to the strands of hair of the hair extension by at least one of:

(a) the top surface, (b) a first side surface of the pair of laterally spaced apart side surfaces, and (c) a second side surface of the pair of laterally spaced apart side surfaces.

6. A method of supporting hair extensions as recited in claim 1, the method further comprising a step of:

supporting the elongated platform by a support member secured to a bottom surface of the elongated platform.

7. A method of supporting hair extensions, the method comprising steps of:

placing hair extensions into a hair extension bar comb assembly, the hair extension bar comb assembly comprising:

an elongated platform comprising a top working surface and a pair of laterally spaced apart side surfaces, each side surface extending in one of (a) a direction generally downward from a respective one of a first transition region or a second transition region or (b) a direction generally downward and outward from a respective one of a first transition region or a second transition region at an obtuse angle from a generally horizontal orientation, a first comb teeth row extending in a generally upward direction from a location on the elongated platform proximate the respective one of the first transition region or the second transition region, the first comb teeth row extending in the generally upward direction from a position on the elongated platform that is one of (a) at the top working surface or (b) below the top working surface, and a second comb teeth row extending in a generally upward direction from a location on the elongated platform proximate the respective other of the first transition region or the second transition region, the second comb teeth row extending in the generally upward direction from a position on the elongated platform that is one of (a) at the top working surface or (b) below the top working surface, each of the first comb teeth row and the second comb teeth row having a multiplicity of spatially arranged teeth, wherein at least a portion of the multiplicity of teeth in one of the first comb teeth row and second comb teeth row is adapted to capture strands of hair of the hair extension therebetween, positioning a bonded section of each hair extension at a location between the first comb teeth row and the second comb teeth row, where a first portion of strands of hair of the respective hair extension is positioned between two adjacent teeth of the first comb teeth row and a second portion of strands of hair of the respective hair extension is positioned between a different two adjacent teeth of the first comb teeth row;

arranging and treating the hair extensions in accordance with at least one of:

(a) locating the bonded section of the respective hair extension to rest against the top working surface located between the first comb teeth row and the second comb teeth row and applying a hair processing treatment onto the bonded section of the respective hair extension, and;

(b) securing a backing sheet to the elongated platform, locating the strands of hair of the hair extension to rest against the backing sheet, and applying the hair processing treatment onto the strands of hair of the respective hair extension resting against the backing sheet.

8. A method of supporting hair extensions as recited in claim 7, wherein gaps between adjacent teeth of the first comb teeth row and gaps between adjacent teeth of the second comb teeth row are located at one of proximate or passing across the top working surface of the elongated platform, the method further comprising a step of:

positioning the first portion of strands of hair of the respective hair extension within the gap between two adjacent teeth of the first comb teeth row and resting a hair strand connecting element against the top working surface.

9. A method of supporting hair extensions as recited in claim 7, the method further comprising a step of:

positioning a third portion of strands of hair of the respective hair extension between two adjacent teeth of the second comb teeth row.

10. A method of supporting hair extensions as recited in claim 7, wherein the hair processing treatment is an application of a color.

11. A method of supporting hair extensions as recited in claim 7, wherein the step of securing a backing sheet to the elongated platform, locating the strands of hair of the hair extension to rest against the backing sheet, and applying the hair processing treatment onto the strands of hair of the respective hair extension resting against the backing sheet includes a step of securing the backing sheet to one of the laterally spaced apart side surfaces.

12. A method of supporting hair extensions as recited in claim 7, the method further comprising a step of:

supporting the elongated platform by a support member secured to a bottom surface of the elongated platform.

13. A method of supporting hair extensions, the method comprising steps of:

placing hair extensions into a hair extension bar comb assembly, the hair extension bar comb assembly comprising:

an elongated platform comprising a top working surface, the top working surface being substantially planar and extending laterally and continuously across a plane defined by top surfaces of a pair of laterally spaced apart side surfaces, each side surface extending in a direction substantially downward and outward from a respective one of a first transition region or a second transition region at an obtuse angle from a generally horizontal orientation, a first comb teeth row extending in a generally upward direction from a location on the elongated platform proximate the respective one of the first transition region or the second transition region, the first comb teeth row extending in the generally upward direction from a position on the elongated platform that is one of (a) at the top working surface or (b) below the top working surface, and a second comb teeth row extending in a generally upward direction from a location on the elongated platform proximate the respective other of the first transition region or the second transition region, the second comb teeth row extending in the generally upward direction from a position on the elongated platform that is one of (a) at the top working surface or (b) below the top working surface, each of the first comb teeth row and the second comb teeth row having a multiplicity of spatially arranged teeth, wherein at least a portion of the multiplicity of teeth in one of the first comb teeth row and second comb teeth row is adapted to capture strands of hair of the hair extension therebetween, positioning a bonded section of each hair extension to rest against the top working surface at a location between the first comb teeth row and the second comb teeth row, where a first portion of strands of hair of the respective hair extension is positioned between two adjacent teeth of the first comb teeth row and a second portion of strands of hair of the respective hair extension is positioned between a different two adjacent teeth of the first comb teeth row; and applying a hair processing treatment onto the bonded section of the respective hair extension.

14. A method of supporting hair extensions as recited in claim 13, wherein gaps between adjacent teeth of the first comb teeth row and gaps between adjacent teeth of the second comb teeth row are located at one of proximate or passing across the top working surface of the elongated platform, the method further comprising a step of:

positioning the first portion of strands of hair of the respective hair extension within the gap between two adjacent teeth of the first comb teeth row and resting a hair strand connecting element against the top working surface.

15. A method of supporting hair extensions as recited in claim 13, the method further comprising a step of:

positioning a third portion of strands of hair of the respective hair extension between two adjacent teeth of the second comb teeth row.

16. A method of supporting hair extensions as recited in claim 13, the method further comprising a step of:

applying at least one of a color and a treatment to the strands of hair of the hair extension while the hair extension is supported by the hair extension bar comb assembly.

17. A method of supporting hair extensions as recited in claim 13, the method further comprising steps of:

applying at least one of a color and a treatment to the strands of hair of the hair extension while the hair extension is supported by the hair extension bar comb assembly; and providing a backing support to the hair extension during the step of applying at least one of a color and a treatment to the strands of hair of the hair extension by at least one of:

(a) the top surface, (b) a first side surface of the pair of laterally spaced apart side surfaces, and (c) a second side surface of the pair of laterally spaced apart side surfaces.

18. A method of supporting hair extensions as recited in claim 13, the method further comprising a step of:

supporting the elongated platform by a support member secured to a bottom surface of the elongated platform.

19. A method of supporting hair extensions, the method comprising steps of:

placing hair extensions into a hair extension bar comb assembly, the hair extension bar comb assembly comprising:

an elongated platform comprising a top working surface, the top working surface being substantially planar and extending laterally and continuously across a plane defined by top surfaces of a pair of elongated edges, and a pair of laterally spaced apart side surfaces, each side surface extending in a direction generally downward and outward from each respective edge at an obtuse angle from a generally horizontal orientation, a first comb teeth row extending in a generally upward direction from a location on the elongated platform proximate a first elongated edge of the pair of elongated edges, the first comb teeth row extending in the generally upward direction from a position on the elongated platform that is one of (a) at the top working surface or (b) below the top working surface, and a second comb teeth row extending in a generally upward direction from a location on the elongated platform proximate a second elongated edge of the pair of elongated edges, the second comb teeth row extending in the generally upward direction from a position on the elongated platform that is one of (a) at the top working surface or (b) below the top working surface, each of the first comb teeth row and the second comb teeth row having a multiplicity of spatially arranged teeth, wherein at least a portion of the multiplicity of teeth in one of the first comb teeth row and second comb teeth row is adapted to capture strands of hair of the hair extension therebetween, positioning a bonded section of each hair extension at a location between the first comb teeth row and the second comb teeth row, where a first portion of strands of hair of the respective hair extension is positioned between two adjacent teeth of the first comb teeth row and a second portion of strands of hair of the respective hair extension is positioned between a different two adjacent teeth of the first comb teeth row and the bonded section of the respective hair extension rests against the top working surface located between the first comb teeth row and the second comb teeth row; and applying a hair processing treatment onto the bonded section of the respective hair extension.

20. A method of supporting hair extensions as recited in claim 19, wherein gaps between adjacent teeth of the first comb teeth row and gaps between adjacent teeth of the second comb teeth row are located at one of proximate or passing across the top working surface of the elongated platform, the method further comprising a step of:

positioning the first portion of strands of hair of the respective hair extension within the gap between two adjacent teeth of the first comb teeth row and resting a hair strand connecting element against the top working surface.

21. A method of supporting hair extensions as recited in claim 19, the elongated platform having a transverse cross section that is trapezoidal in shape, the method further comprising a step of:

supporting the strands of hair of the hair extension against the pair of laterally spaced apart side surfaces during a step of processing of the strands of hair.

22. A method of supporting hair extensions as recited in claim 19, the method further comprising a step of:

positioning a third portion of strands of hair of the respective hair extension between two adjacent teeth of the second comb teeth row.

23. A method of supporting hair extensions as recited in claim the method further comprising a step of:

applying at least one of a color and a treatment to the strands of hair of the hair extension while the hair extension is supported by the hair extension bar comb assembly.

24. A method of supporting hair extensions as recited in claim 19, the method further comprising steps of:

applying at least one of a color and a treatment to the strands of hair of the hair extension while the hair extension is supported by the hair extension bar comb assembly; and providing a backing support to the hair extension during the step of applying at least one of a color and a treatment to the strands of hair of the hair extension by at least one of:

(a) the top surface, (b) a first side surface of the pair of laterally spaced apart side surfaces, and (c) a second side surface of the pair of laterally spaced apart side surfaces.

25. A method of supporting hair extensions as recited in claim 19, the method further comprising a step of:

supporting the elongated platform by a support member secured to a bottom surface of the elongated platform.

* * * * *